US007726912B2

(12) United States Patent
Polk, Jr. et al.

(10) Patent No.: US 7,726,912 B2
(45) Date of Patent: Jun. 1, 2010

(54) SUPPORT STRUCTURE

(75) Inventors: Dale E. Polk, Jr., Titusville, FL (US); Victor Wolynski, Cocoa, FL (US); Dean Higley, Titusville, FL (US)

(73) Assignee: LRM Industries International, Inc., Rockledge, FL (US)

( * ) Notice: Subject to any disclaimer, the term of this patent is extended or adjusted under 35 U.S.C. 154(b) by 0 days.

(21) Appl. No.: 12/102,040

(22) Filed: Apr. 14, 2008

(65) Prior Publication Data

US 2008/0273926 A1 Nov. 6, 2008

Related U.S. Application Data

(60) Provisional application No. 60/927,350, filed on May 3, 2007.

(51) Int. Cl.
*E02D 5/24* (2006.01)
*E04G 5/06* (2006.01)

(52) U.S. Cl. ..... 405/218; 405/221

(58) Field of Classification Search ..... 405/218, 405/221; 52/263, 299, 650.1, 650.3, 651.01, 52/655.1; 248/165, 676; 108/106, 107, 110, 108/147.12–147.17; 211/187, 190–192
See application file for complete search history.

(56) References Cited

U.S. PATENT DOCUMENTS 1,473,817 A * 11/1923 Gorsline ..... 108/157.17
3,999,397 A 12/1976 Albery
4,173,934 A * 11/1979 Searby ..... 108/107
4,349,297 A 9/1982 Misener
4,548,377 A 10/1985 Huel
5,048,448 A 9/1991 Yoder
5,133,276 A 7/1992 Alesi, Jr. et al.
5,297,899 A 3/1994 Culley (Continued)

FOREIGN PATENT DOCUMENTS

JP 62202118 9/1987

*Primary Examiner*—David J Bagnell
*Assistant Examiner*—Benjamin Fiorello
(74) *Attorney, Agent, or Firm*—Michael A. Ervin; M.A. Ervin & Associates

(57) ABSTRACT

A support structure (1) that includes a support panel (11), at least one pile (14) having associated therewith at least one bracket (17) and at least one mounting strap (20). Each bracket (17) includes a lower portion (70), at least one extension (91, 92) extending upward from the lower portion (70), and a retainer (85) extending outward from a first surface (73) of the lower portion (70). The retainer (85) of the bracket (17) is received within an aperture (67) of an apertured sidewall (64, 215, 218) of the pile (14). At least one mounting strap (20, 23) maintains: the first surface (73) of the lower portion (70) of the bracket (17) in abutting relationship with the apertured sidewall (64) of the pile; and the retainer (85) within the aperture (67) thereof. A first surface (94) of the extension (91, 92) of the bracket (17) and the apertured sidewall (64) of the pile (14) together define a vertical slot (112) having an open top (115) and a closed bottom (118). The support panel (11) includes at least one downwardly extending sidewall (33) that is received within the vertical slot (112). Receipt of the sidewall (33) within the vertical slot (112) serves to support the support panel (11). The support structure may be used as a dock, such as a marine dock.

25 Claims, 14 Drawing Sheets

U.S. PATENT DOCUMENTS

| | | | |
|---|---|---|---|
| 5,337,986 | A | 8/1994 | Vollink |
| 5,664,513 | A | 9/1997 | Echelbarger |
| 5,732,649 | A | 3/1998 | Falcone |
| 6,003,464 | A | 12/1999 | Long |
| 6,089,176 | A | 7/2000 | Costello |
| 6,695,541 | B1 | 2/2004 | Spence |
| 6,912,966 | B2 | 7/2005 | Ostreng et al. |
| 7,144,199 | B2 | 12/2006 | Bontje |
| 2004/0159622 | A1 | 8/2004 | Craft et al. |

* cited by examiner

SUPPORT STRUCTURE

The present nonprovisional patent application is entitled to and claims the right of priority under 35 U.S.C. §119(e) of U.S. Provisional Patent Application Ser. No. 60/927,350 filed May 3, 2007, which is hereby incorporated herein in its entirety by reference.

FIELD OF THE INVENTION

The present invention relates to a support structure, such as a marine dock, that includes a support panel, at least one pile, at least one bracket and at least one mounting strap. The first surface of the lower portion of the bracket has a retainer extending laterally outward therefrom. The retainer is received within an aperture of an apertured sidewall of the pile. The mounting strap maintains the first surface of the lower portion of the bracket and the apertured sidewall of the pile in abutting relationship. A first surface of an extension of the bracket and the apertured sidewall of the pile together define a vertical slot. A downwardly extending sidewall of the support panel is supportively received within the vertical slot, and the support panel is accordingly supported by the combination of the pile, bracket and mounting strap.

BACKGROUND OF THE INVENTION

Support structures, such as decks and docks are typically fabricated from numerous components, such as posts, cross-members, stringers, brackets, and deck members. Typically, the various components of docks and decks are attached together by means of fasteners, such as screws and/or bolts. For example, brackets are typically attached to the posts and cross-members and/or decks by means of screws and/or bolts. See, for example, U.S. Pat. Nos. 3,999,397, 4,349,297 and 6,695,541 B1. The use of fasteners generally contributes to difficulties experienced when assembling and more particularly when disassembling such decks and docks. For example, the use of fasteners usually requires additional tools. In the case of docks, exposure of the fasteners to fresh water and in particular salt water environments results in corrosion and fusing thereof, which can make disassembly of the dock exceptionally difficult (e.g., requiring cutting the fasteners, which can result in damage to the dock components).

The presence of cross-members in the deck or dock assemblies increases the weight and volume of materials that are shipped to the point of assembly. Increased shipping weights and volumes typically result in increased shipping costs, due at least in part to increased fuel costs. In addition, cross-members can also increase difficulties encountered in assembling the deck or dock (e.g., resulting from additional bracket attachment and leveling steps).

It would be desirable to develop new support structure designs that do not require the use of fasteners. In addition, it would be desirable that such newly developed support structure designs include self supporting deck or support panels that do not require the use of cross-members.

SUMMARY OF THE INVENTION

In accordance with the present invention, there is provided, a support structure comprising:

(a) a support panel comprising an upper support surface, an under surface, and at least one sidewall (e.g., 2, 3, 4 or more sidewalls) extending downwardly from said under surface, each sidewall having a lower edge;

(b) at least one pile, each pile having an elongated body having an upper portion, a lower portion, and sidewalls, at least one sidewall of said pile being an apertured sidewall having at least one aperture located in said upper portion of said apertured sidewall;

(c) at least one bracket, each bracket comprising, (i) a lower portion having a first side, a second side, an upper ledge, and a base, said first side and said second side of said lower portion being substantially opposed from each other, (ii) a retainer extending laterally outward from said first side of said lower portion of said bracket, and (iii) at least one extension extending vertically upward from said second side of said lower portion of said bracket, each extension having a first side, a second side, an upper terminus, and a lower terminus, said second side of said extension extending laterally outward beyond said second side of said lower portion of said bracket, said upper terminus of said extension residing above said ledge of said lower portion of said bracket, and said lower terminus of said extension residing above said base of said lower portion of said bracket, wherein for each pile, said first side of said lower portion of said bracket abutting said apertured sidewall on said upper portion of said elongated body of said pile, said retainer of said bracket being received within said aperture of said apertured sidewall, and said first surface of each extension of said bracket and said apertured sidewall of said pile together defining a vertical slot having an open top and a closed bottom defined by said upper ledge of said lower portion of said bracket; and (d) at least one mounting strap, extending tensionally around said upper portion of said elongated body of said pile and said lower portion of said bracket, thereby maintaining said first side of said lower portion of said bracket and said apertured sidewall of said pile in abutting relationship, and maintaining said retainer within said aperture, wherein, a portion of said sidewall of said support panel is supportively received within said vertical slot such that, at least one of, (i) said upper terminus of said extension abuts said under surface of said support panel, and (ii) said lower edge of said sidewall of said support panel abuts said upper ledge of said lower portion of said bracket.

In a further embodiment of the present invention, the elongated body of each pile has an upper end and a lower end and further comprises, (i) a first exterior elongated plate, (ii) a second exterior elongated plate, said first exterior elongated plate and second exterior elongated plate being spaced apart and being substantially opposed from each other, and (iii) a plurality of internal ribs interposed between said first exterior elongated plate and said second exterior elongated plate, said plurality of internal ribs defining at least one elongated passage, and said plurality of internal ribs together defining a plurality of apertures, wherein said first exterior elongated plate, said second exterior elongated exterior plate and said plurality of internal ribs are each independently fabricated from a plastic material and are substantially continuous with each other, and said elongated body is a substantially unitary elongated body, further wherein, said plurality of internal ribs define the apertured sidewall (equivalently, the first and/or second elongated open sides) of said pile, and said plurality of apertures include said aperture located in said upper portion of said apertured sidewall.

The features that characterize the present invention are pointed out with particularity in the claims, which are annexed to and form a part of this disclosure. These and other features of the invention, its operating advantages and the specific objects obtained by its use will be more fully understood from the following detailed description and accompanying drawings in which preferred embodiments of the invention are illustrated and described.

As used herein and in the claims, terms of orientation and position, such as "upper", "lower", "inner", "outer", "right", "left", "vertical", "horizontal", "top", "bottom", and similar terms, are used to describe the invention as oriented in the drawings. Unless otherwise indicated, the use of such terms is not intended to represent a limitation upon the scope of the invention, in that the invention may adopt alternative positions and orientations.

Unless otherwise indicated, all numbers or expressions, such as those expressing structural dimensions, quantities of ingredients, etc., as used in the specification and claims are understood as modified in all instances by the term "about".

BRIEF DESCRIPTION OF THE DRAWINGS

FIG. 14 is a representative perspective view of a bracket according to the present invention in which the facing side surfaces of the adjacent extensions together define a V-shaped vertical space there-between.

In FIGS. 1 through 14, like reference numerals designate the same components and structural features, unless otherwise indicated.

DETAILED DESCRIPTION OF THE INVENTION

Figure 1:
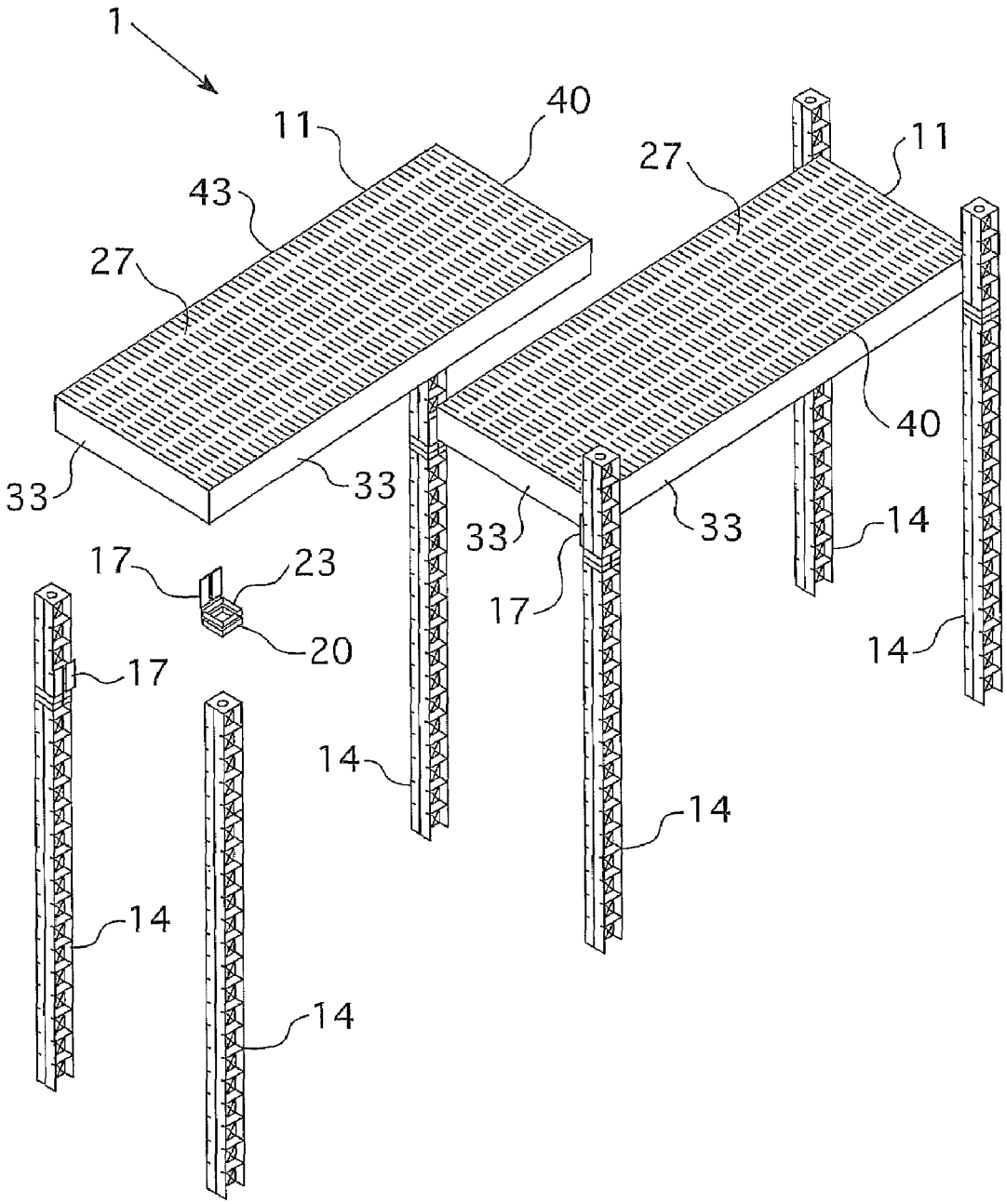
FIG. 1 is a representative partially exploded perspective view of a support structure according to the present invention.
Figure 5:
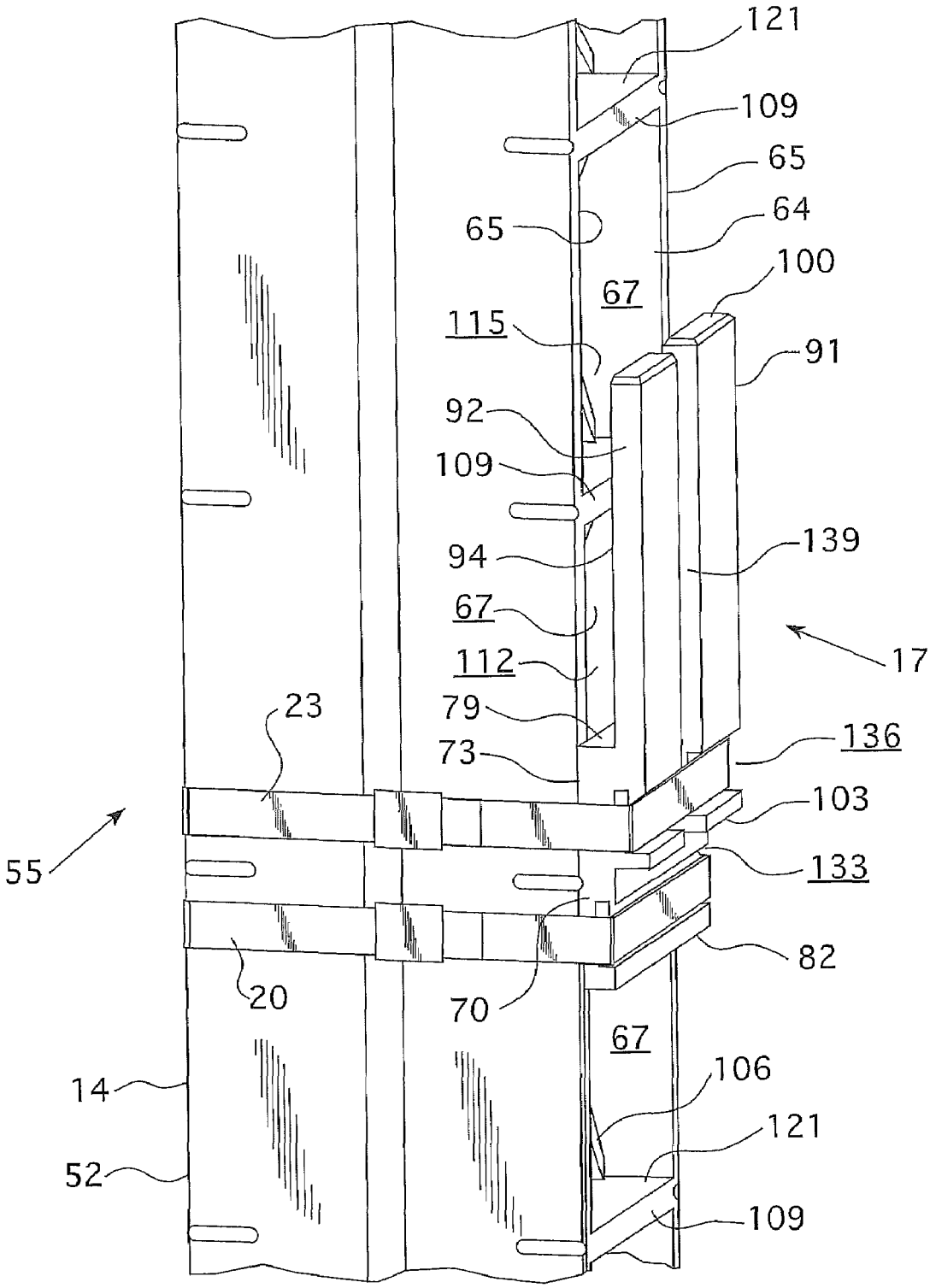
FIG. 5 is a representative perspective view of a bracket maintained in abutting relationship with the upper portion of the apertured sidewall of a pile by first and second mounting straps.

With reference to FIG. 1 of the drawings, the support structure 1, according to the present invention, includes at least one support (or deck) panel 11 and at least one pile 14. Each pile 14 has associated therewith at least one bracket 17. As more clearly depicted in FIG. 5, support structure 1 further includes at least one mounting strap 20. A further mounting strap 23 is also depicted in FIG. 5, as will be discussed in further detail herein.

Figure 2:
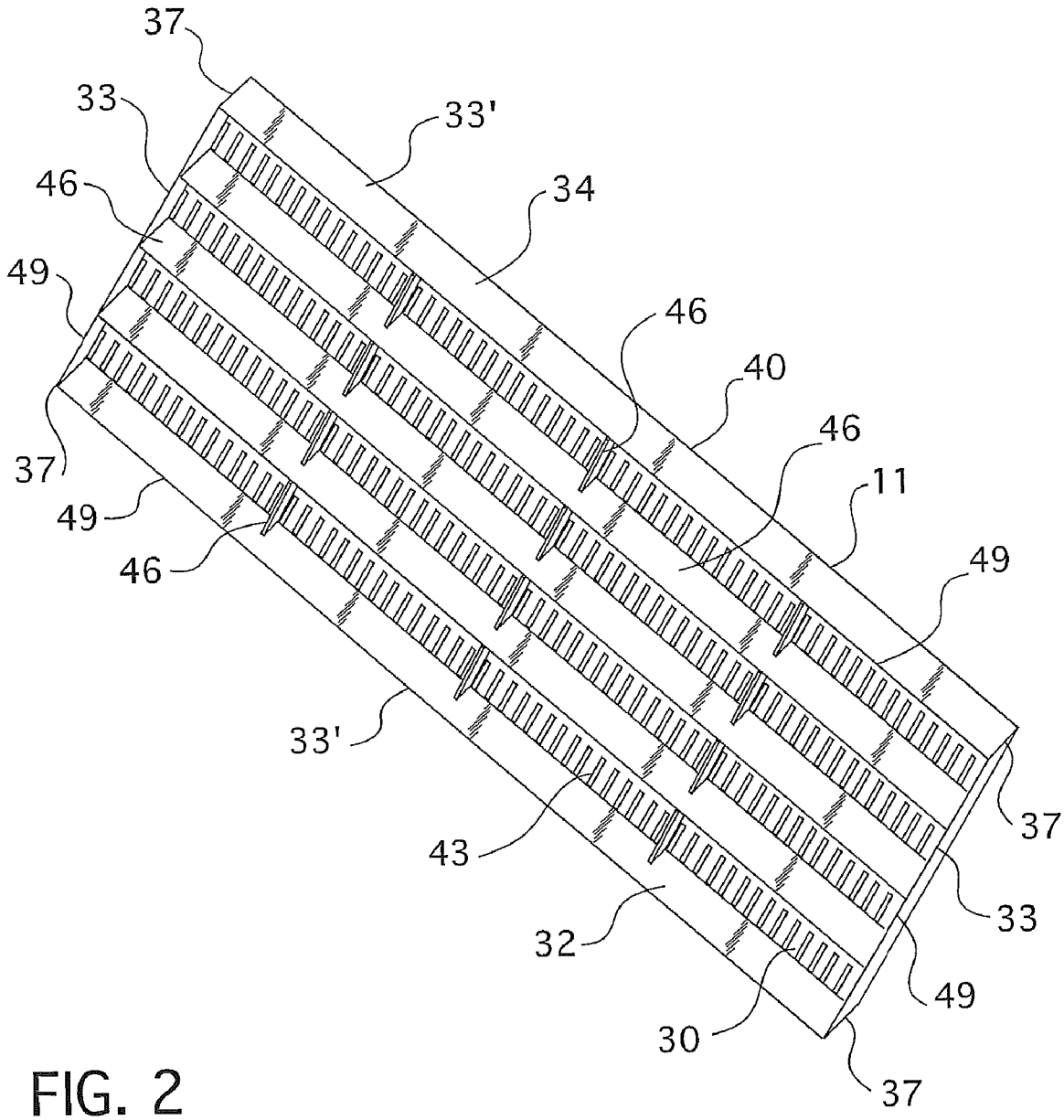
FIG. 2 is a representative perspective view of the underside of a support panel of the support structure of the present invention.

Each support panel 11 includes an upper support surface 27, an under surface 30 (FIG. 2), and at least one sidewall 33 extending downwardly from under surface 30. Each sidewall 33 has a lower edge 49, and a thickness. Lower edge 49 of sidewall 33 may have a profile selected, for example, from: substantially straight or smooth profiles (as depicted in the drawings); irregular profiles (e.g., serrated, such as sharp and/or smooth serrations); and combinations thereof.

Typically, support panel 11 has at least two sidewalls 33, in which case, the sidewalls may be opposed to each other and/or adjacent to each other. In a further embodiment, and with reference to FIG. 2, support panel 11 has at least two sidewalls (e.g., 33 and 33') that are adjacent sidewalls, and which together define a corner 37. In an embodiment, and as depicted in the drawings, support panel 11 has four sidewalls 33, in which: sidewall pairs 33 and 33 are opposed to each other; sidewall pairs 33' and 33' are opposed to each other; and sidewall pairs 33 and 33' are adjacent sidewalls and together define each corner 37, of which there are four. The sidewalls of support panel 11 may be referred to herein individually and collectively as sidewall(s) 33.

Support panel 11 may have a perimeter edge 40. Each sidewall 33 may independently extend downwardly from under surface 30 of support panel 11, from a position that is: laterally inward relative to perimeter edge 40 (not depicted in the drawings); and/or substantially aligned with perimeter edge 40. In an embodiment, each sidewall 33 extends downwardly from both under surface 30 and perimeter edge 40 of support panel 11, as depicted in the drawings.

The support panel of the support structure may be fabricated from any suitable self-supporting material. For example, the support panel may be fabricated from wood, metal, plastic materials, and combinations thereof. In an embodiment, the support panel is fabricated from one or more plastic materials, as will be described in further detail herein.

Upper support surface 27 of support panel 11 may be a continuous and closed surface having a substantially smooth profile, and/or a substantially non-smooth profile having, for example, raised portions and lowered portions (e.g., grooves). Providing upper support surface 27 with a grooved profile (not shown) may be desirable for reasons including, but not limited to, channeling water off of support surface 27 and/or improving the traction of upper support surface 27.

Support panel 11 may include a plurality of perforations 43 (FIG. 6) that extend from upper support surface 27 to under surface 30 thereof. Perforations 43 allow ambient light to pass through support panel 11, thus maintaining the viability of photosynthesis supported flora and fauna that may reside under support structure 1. Alternatively, or in addition thereto, liquid (e.g., rain water) contacting upper support surface 27 may pass through perforations 43 and under support structure 11, in particular, when perforations 43 are defined by downwardly curved (or chamfered) edges (not shown) that are continuous with upper support surface 27.

To obtain a desirable balance of weight and strength properties, the underside of the support panel may be provided with a plurality of ribs 46 (e.g., plastic ribs). The ribs may be separate from sidewall 33 and/or under surface 30. More typically, the plurality of ribs 46 are continuous with under surface 30 and sidewalls 33 of support panel 11 (e.g., when support panel 11 is fabricated from one or more plastic materials).

The support panel of the support structure of the present invention, preferably is a self supporting support panel, in which case the support structure of the present invention is free of cross-members extending between the piles and to which the support panel would otherwise be attached. A self supporting support panel (e.g., support panel 11) may be attached to piles 14 via brackets 17, in the absence of interposed load bearing cross-members. The presence of ribs 46 (e.g., plastic ribs) serves to enhance the self-supporting properties of the support panel of the support structure of the present invention. For purposes of illustration, a self supporting support panel according to the present invention, (e.g., support panel 11 as depicted in the drawings) fabricated from virgin polypropylene and having width by length dimensions of 122 cm by 305 cm (4 feet by 10 feet), undergoes a vertical deflection of no more than 16 mm (⅝ inch), when a static 227 Kg (500 pound) weight is placed in the center thereof on upper support surface 27.

Support panel 11 and its various components (e.g., upper support surface 27, sidewalls 33 and ribs 46) may be separately assembled, in which case, the support panel is a non-unitary support panel. In an embodiment, support panel 11 is a substantially unitary support panel, in which the various components thereof (e.g., upper support surface 27, sidewalls 33 and ribs 46) are substantially continuous with each other (e.g., when fabricated from plastic material).

The support structure of the present invention also includes at least one pile 14. In the case of a single pile, one end of the support panel may be supported by a separate structure, such as a ledge, shore line or river bank, while the opposite end is supported by one pile (having a bracket 17 associated therewith). More typically, the support structure of the present invention has at least two piles (e.g., 2, 3, 4, 5, 6 or more piles).

Figure 7:
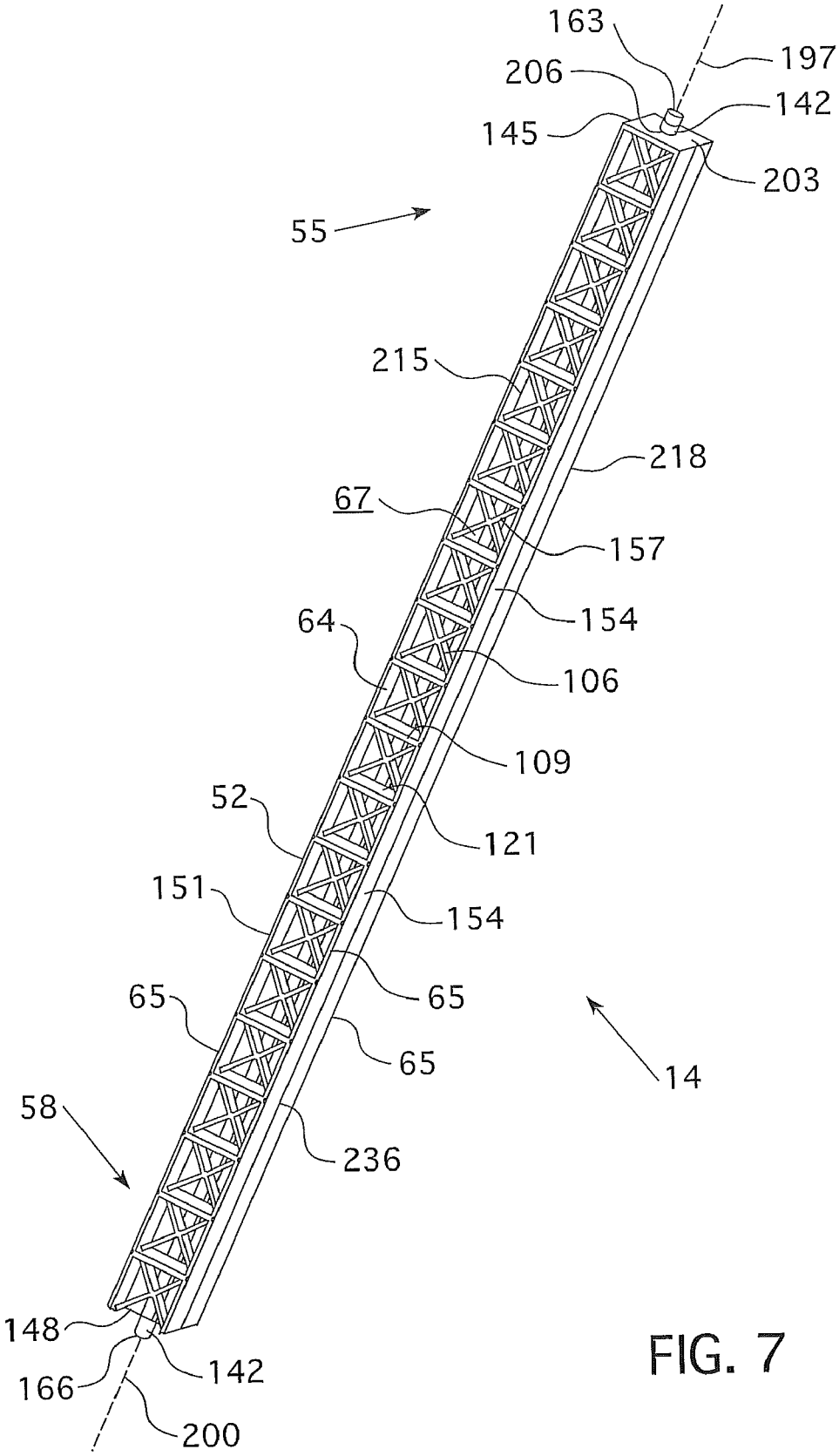
FIG. 7 is a representative perspective view of a pile according to the present invention that includes an elongated tube extending through the elongated passage thereof.
Figure 8:
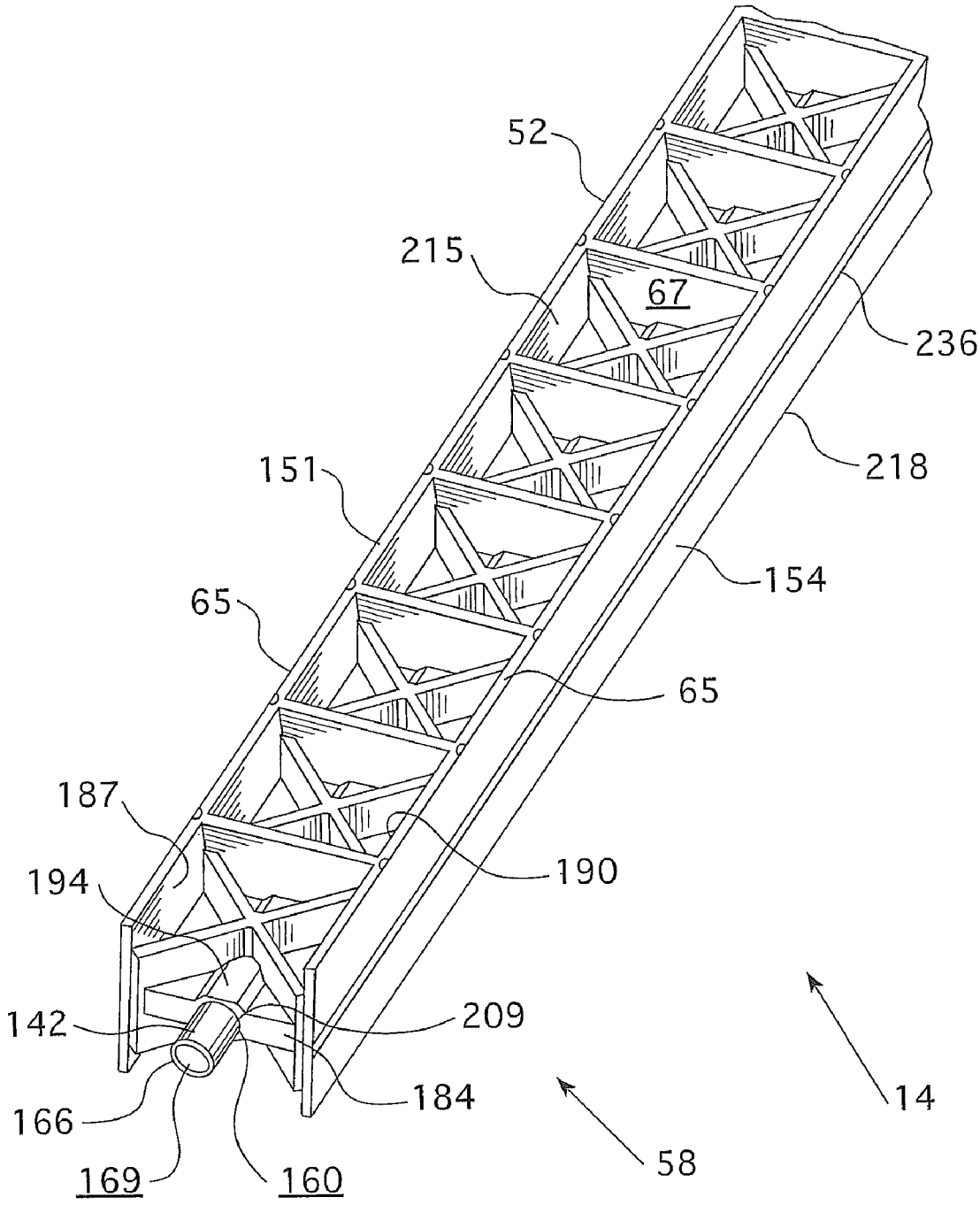
FIG. 8 is a perspective view of the lower portion and lower end of the pile of FIG. 7.

With reference to FIGS. 7 and 8 of the drawings, each pile 14 has an elongated body 52, which has an upper portion 55, a lower portion 58, and sidewalls (e.g., sidewall 61). At least one sidewall (or a portion of the sidewall) of pile 14 is an apertured sidewall 64 having at least one aperture 67 located in at least upper portion 55 of elongated body 52. Typically, apertured sidewall 64 may have apertures 67 along its entire length, e.g., from lower portion 58 through upper portion 55 of elongated body 52 of pile 14 (as shown in the drawings).

Apertures 67 of apertured sidewall 64 may, in an embodiment, be defined by a plurality of internal ribs (e.g., angled ribs 106 and cross/lateral ribs 109) within elongated body 52 of pile 14, as will be discussed in further detail herein.

The elongated body of the pile, and accordingly the pile, may have a cross-sectional shape selected from cylindrical shapes, oval shapes (e.g., elliptical), polygonal shapes (e.g., triangular, rectangular, square, pentagonal, hexagonal, heptagonal, octagonal, etc.), irregular shapes, and combinations thereof. Typically, the pile has a cross-sectional shape that is selected from polygonal shapes, and in particular rectangular and/or square shapes.

The pile of the support structure may be fabricated from any suitable self-supporting material. For example, the pile may be fabricated from wood, metal, plastic materials, and combinations thereof. In an embodiment, the pile is fabricated from one or more plastic materials, as will be described in further detail herein.

As used herein and in the claims the term "lower portion" with regard to the elongated body of the pile means that portion which is or may be retained within a penetrable material (e.g., earth, sand, or a cementatious material, such as cement, Portland cement). Accordingly, the "upper portion" of the elongated body of the pile is that portion which is not (or may not be) retained within a penetrable material. Typically, the length of the lower portion of the elongated body of the pile represents from 10 percent to less than 50 percent, more typically from 15 percent to 45 percent, and further typically from 20 percent to 40 percent, based on the total length of the elongated body of the pile. The length of the upper portion of the elongated body of the pile typically represents from 50 percent to 90 percent, more typically from 55 percent to 85 percent, and further typically from 60 percent to 80 percent, based on the total length of the elongated body of the pile. Unless otherwise noted, the recited percent length values are inclusive of the recited values.

In an embodiment, one or more of the piles, and in particular the lower ends of the pile(s), rest on a separate structure, such as a concrete footer (not shown), rather than being retained within the separate structure or a material, such as a penetrable material (e.g., earth). When resting on a separate structure, the lower portion and/or lower end of the pile may be secured to the separate structure by art-recognized means, such as tie-rods and/or tie-cables (not shown). When resting on and/or secured to a separate structure, the previously recited percent length ranges relative to the upper and lower portions of the pile are also applicable.

Figure 3:
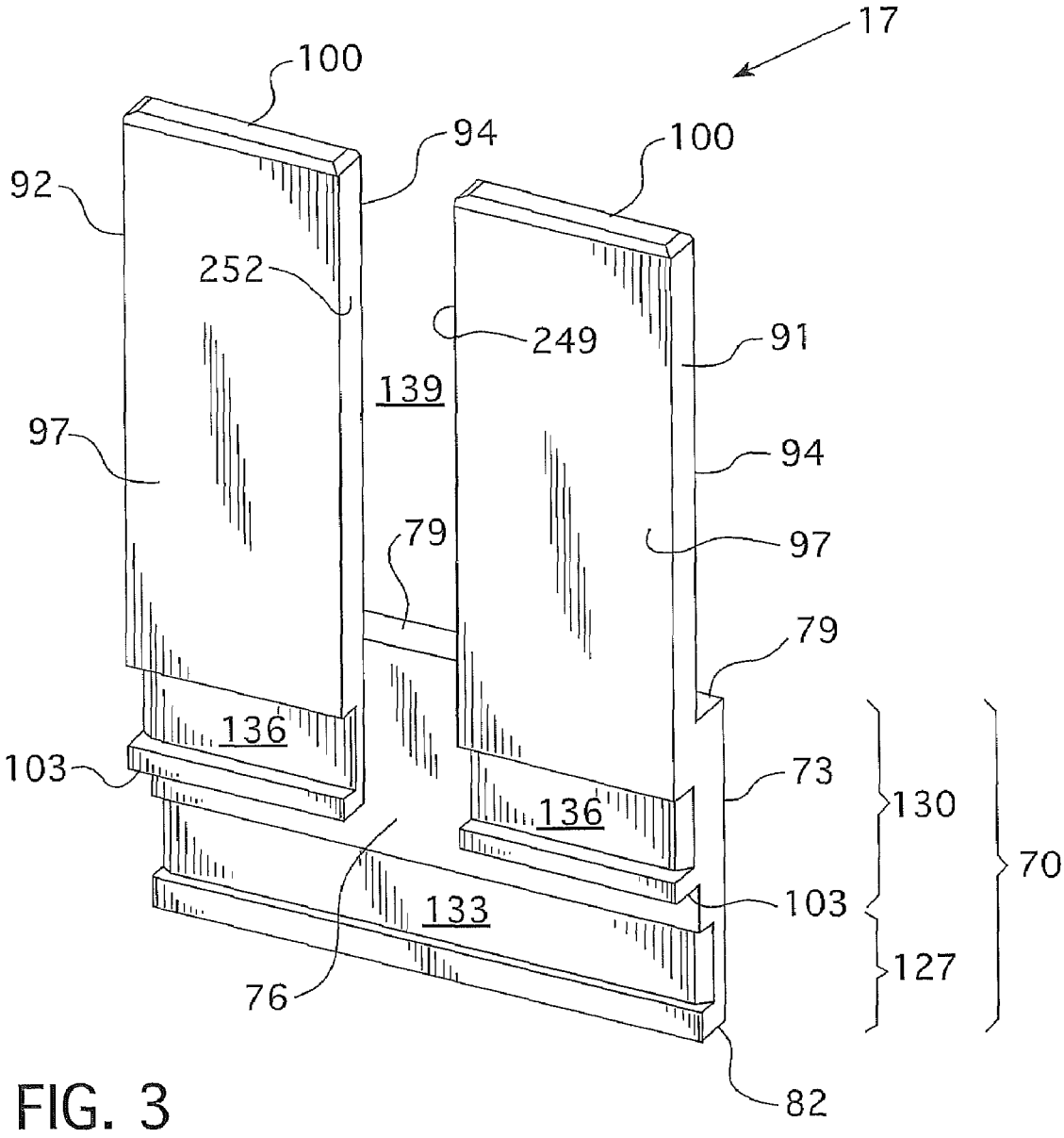
FIG. 3 is a representative perspective view of a bracket of the support structure of the present invention.
Figure 4:
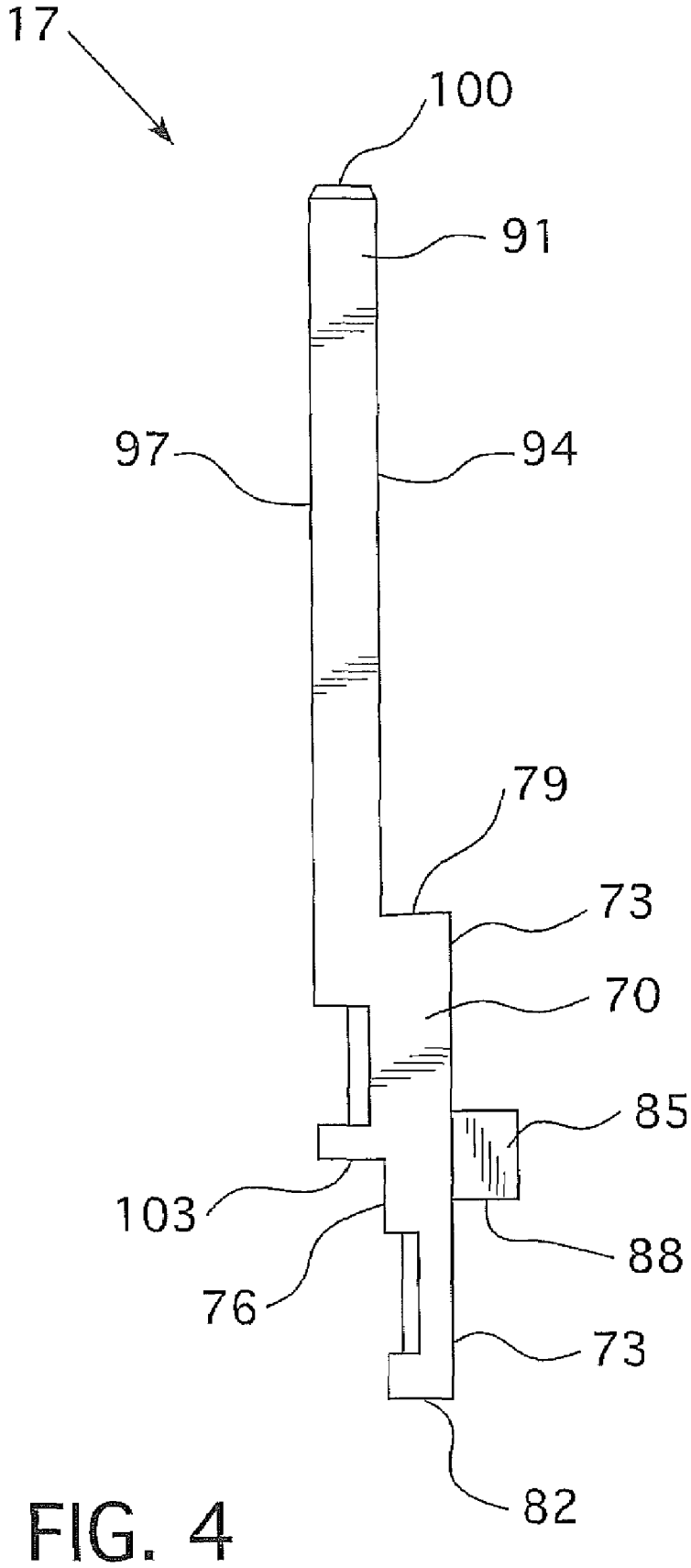
FIG. 4 is a representative elevational side view of the bracket depicted in FIG. 3.

With particular reference to FIGS. 3 and 4, each bracket 17 of the support structure 1 of the present invention includes a lower portion 70. Lower portion 70 has a first side 73, a second side 76, an upper ledge 79 and a base 82. First side 73 and second side 76 of lower portion 70 of bracket 17 are substantially opposed from each other (i.e., face in opposite directions).

Lower portion 70 of bracket 17 also includes a retainer 85 that extends laterally outward from first side 73 of lower portion 70. Retainer 85 has a lower surface 88.

Bracket 17 further includes at least one extension (e.g., first extension 91 and second extension 92), which extends vertically upward from second side 76 of lower portion 70 of the bracket. Unless otherwise indicated, the description of first extension 91 is applicable to second extension 92, and visa versa. Each extension (91, 92) has a first side 94, a second side 97, an upper terminus 100, and a lower terminus 103. The first surface 94 and the second surface 97 of each extension (91, 92) of bracket 17 are substantially opposed from each other (i.e., face in opposite directions).

Second side 97 of each extension (91, 92) extends laterally outward beyond second side 76 of lower portion 70 of bracket 17. First surface 73 of lower portion 70 of bracket 17 is positioned laterally outward relative to first surface 94 of each extension (91, 92) of bracket 17. Correspondingly, first surface 94 of each extension (91, 92) of bracket 17 is positionally set-back (or recessed) relative to first surface 73 of lower portion 70 of bracket 17.

Upper terminus 100 of each extension (91, 92) resides vertically above ledge 79 of lower portion 70 of bracket 17. Lower terminus 103 of each extension (91, 92) is positioned and resides: vertically above base 82 of lower portion 70 of bracket 17; and vertically below ledge 79 of lower portion 70 of bracket 17.

With the support structure of the present invention, each pile has at least one bracket associated therewith. The pile and bracket(s) are held together by at least one mounting strap (20, 23), as will be discussed further herein. Each bracket is positioned on the upper portion of the elongated body of the pile, and in abutting relationship with an apertured sidewall of the pile.

With reference to FIGS. 3, 4, 5 and 10, first side 73 of lower portion 70 of bracket 17 abuts apertured sidewall 64 on (or in the area of) upper portion 55 of pile 14. More particularly, a portion (e.g., outer edge portion) of first side 73 of lower portion 70 of bracket 17 abuts elongated edges 65 of apertured sidewall side 64 of pile 14. Retainer 85 of lower portion 70 of bracket 17 is received within an aperture 67 of apertured sidewall 64. Receipt of retainer 85 within aperture 67 is not visible in the drawing figures.

First surface 94 of each extension (e.g., 92) of bracket 17 and the apertured sidewall 64 of elongated body 52 of pile 14 together define a vertical slot 112 having an open top 115 and a closed bottom 118. Closed bottom 118 of vertical slot 112 is defined by upper ledge 79 of lower portion 70 of bracket 17. Vertical slot 112 is more particularly defined, in an embodiment, in part by elongated edges 65 of apertured sidewall 64 of pile 14 and first surface 94 of an extension (e.g., 92) of bracket 17. First surface 94 of the extension (91, 92) and elongated edges 65 of apertured sidewall side 64 are in facing opposition.

The support structure further includes at least one mounting strap 20 that extends tensionally around: upper portion 55 of elongated body 52 of pile 14; and lower portion 70 of bracket 17. Mounting strap 20 maintains first side 73 of lower portion 70 of bracket 17 and apertured sidewall 64 (e.g., elongated edges 65 thereof) in abutting relationship. In addition, mounting strap 20 maintains retainer 85 (which extends from first side 73 of lower portion 70) of bracket 17 within aperture 67. Maintaining apertured sidewall 64 and the lower portion 70 of bracket 17 in abutting relationship (by means of mounting strap 20) also serves to maintain first side 94 of each extension (91, 92) is spaced apart relationship relative to apertured sidewall 64 and elongated edges 65 thereof, and thereby accordingly further maintaining vertical slot 112.

Mounting strap 20 substantially prevents lateral movement of bracket 17 relative to apertured sidewall 64 of pile 14. In addition, maintaining retainer 85 of bracket 17 within aperture 67 also serves to substantially prevent vertical movement, and in particular downward vertical movement, of bracket 17. Lower surface 88 of retainer 85 of bracket 17 (FIG. 4) abuts a portion (or those portions) of apertured sidewall 64 that define aperture 67. In an embodiment, lower surface 88 of retainer 85 abuts one or more of the internal ribs (e.g., 106,109) that define the apertures 67 of apertured sidewall 64. More particularly, lower surface 88 of retainer 85 may abut upper surface 121 of cross (or lateral) internal rib 109 of apertured sidewall side 64.

Figure 6:
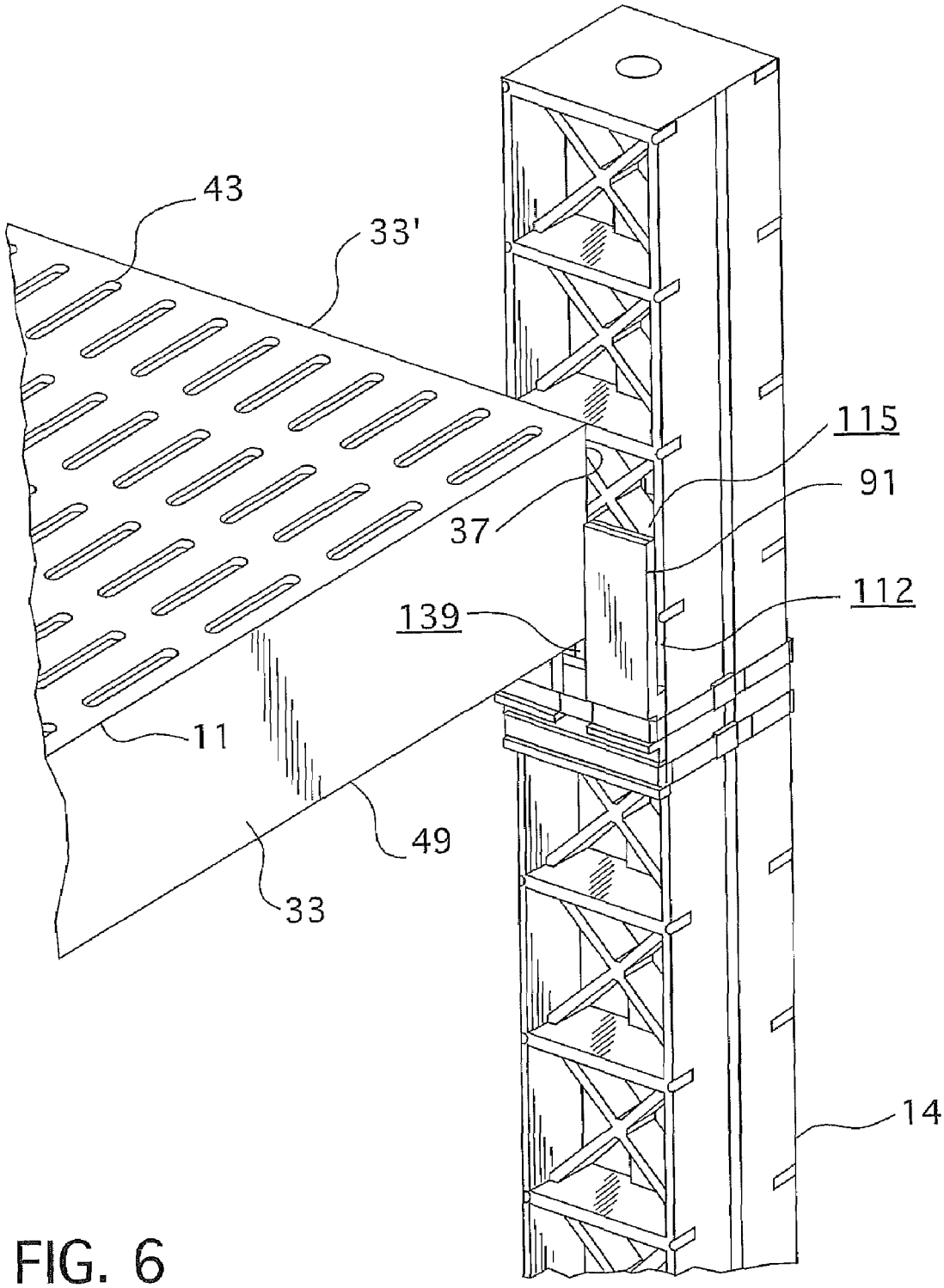
FIG. 6 is a representative partially exploded perspective view of the sidewalls of a support panel being received within the vertical slot formed by the bracket and apertured sidewall of the pile.

The abutting arrangement of the bracket and pile, as maintained by the mounting strap(s), provides a means by which each support panel is supported and held in an elevated position (e.g., above ground and/or water), in the support structure of the present invention. With reference to FIG. 6, a portion of the sidewall (e.g., 33') of support panel 11 is supportively received within vertical slot 112 (that is defined by first surface 94 of extension 91/92 of bracket 17, and apertured sidewall 64).

Supportive receipt of a portion of sidewall 33 within vertical slot 112 results in: (i) upper terminus 100 of extension 91/92 abutting under surface 30 of support panel 11; and/or (ii) lower edge 49 of sidewall 33 of support panel 11 abutting upper ledge 79 (and equivalently closed bottom 118 of vertical slot 112) of lower portion 70 of bracket 17. These abutting relationships (i) and/or (ii) provide support for and maintain support panel 11 in an elevated position, with the support structure of the present invention. Whether abutting relationships (i) and/or (ii) provide elevational support for support panel 11 depends on both the vertical dimension of vertical slot 112 (from base 118 to upper terminus 100), and the vertical distance between lower edge 49 and under surface 30 of support panel 11. For example, if the vertical distance between lower edge 49 of sidewall 33 and under surface 30 of support panel 11 is less than the vertical dimension of vertical slot 112, then upper terminus 100 of the extension 91/92 abuts under surface 30 of support panel 11. If, for example, the vertical distance between lower edge 49 of sidewall 33 and under surface 30 of support panel 11 is greater than the vertical dimension of vertical slot 112, then lower edge 49 of sidewall 33 of support panel 11 abuts upper ledge 79 (and equivalently closed bottom 118 of vertical slot 112) of lower portion 70 of bracket 17; and upper terminus 100 of extension 91/92 does not abut under surface 30 of support panel 11. If, for example, the vertical distance between lower edge 49 and under surface 30 of support panel 11 is substantially equivalent to the vertical dimension of vertical slot 112, then support for support panel 11 is provided by both abutting relationships (i) and (ii).

Typically, the vertical distance between lower edge 49 and under surface 30 of support panel 11 is greater than the vertical dimension of vertical slot 112. And accordingly, support (e.g., elevational support) of support panel 11 is provided alone by, lower edge 49 of sidewall 33 of support panel 11 abutting upper ledge 79 (of lower portion 70 of bracket 17), when sidewall 33 is supportively received within vertical slot 112.

Vertical slot 112 has a width 124 (FIG. 10) that is at least equivalent to the thickness of the portion of sidewall 33 that is received therein. Typically, vertical slot 112 is dimensioned so as to tightly and abuttingly receive and hold the portion of sidewall 33 that is received therein. For example, first surface 94 of extension 92 abuts the interior surface 32 (FIG. 2) of sidewall 33, and at least elongated edges 65 of apertured sidewall 64 abut the exterior surface 34 of sidewall 33.

To augment retention of sidewall 33 of support panel 11 within the vertical slot 112 of the bracket (17)—pile (14)—mounting strap (20 and/or 23) assembly, adhesives and/or fasteners (not shown) may be used. For example, adhesives may be introduced into vertical slot 112 and/or applied to those portions of sidewall 33 received within vertical slot 112, prior to receipt of sidewall 33 within vertical slot 112. Alternatively or in addition to adhesives, after receipt of sidewall 33 within vertical slot 112, one or more fasteners (e.g., screws, rivets, and/or bolt and nut combinations) may be driven through first and second sides (94, 97) of at least one extension (e.g., 91 and/or 92) and at least partially into that portion of sidewall 33 that is received within vertical slot 112. Generally, augmented retention (e.g., by means of adhesives and/or fasteners) of sidewall 33, within vertical slot 112, is not necessary with the support structure of the present invention.

The mounting strap extends tensionally around the upper portion of the elongated body of the pile, and the lower portion of the bracket. As such, the mounting strap(s) may extend tensionally around: (a) the lower portion of the bracket alone (e.g., portion 127), and at the same time no portion of the extension(s); and/or (b) at least a portion of that portion of the extension(s) that is contiguous with the lower portion of the bracket (e.g., portion 130). In an embodiment, mounting strap 20 abuts a portion 127 of second side 76 of lower portion 70 of bracket 17 that resides beneath lower terminus 103 of extension 91/92 and above base 82 of lower portion 70 of bracket 17.

So as to better retain the mounting strap(s) on and minimize displacement (e.g., slippage) thereof (e.g., off of the bracket), the lower portion and/or that portion of the extension(s) that is/are contiguous with the lower portion of the bracket may independently be provided with lateral grooves into which a mounting strap may be received. In an embodiment, a portion (e.g., 127) of second side 76 of lower portion 70 of bracket 17, which resides beneath lower terminus 103 of extension 91/92 and above base 82 of lower portion 70, has a first lateral groove 133. A portion of mounting strap 20 is received within first lateral groove 133. Receipt of a portion of mounting strap 20 within first lateral groove 133 of second side 76 of lower portion 70 of bracket 17, minimizes displacement of mounting strap 20 relative to bracket 17, e.g., minimizing slippage of mounting strap 20 off of bracket 17 (e.g., below base 82 of lower portion 70 of bracket 17).

A portion of the second side 97 of each extension 91/92, that resides beneath upper ledge 79 of lower portion 70 of bracket 17 and above lower terminus 103 of each extension (e.g., portion 130—FIG. 3), may have a second lateral groove 136. If the bracket has more than one extension, the second lateral grooves 136 of each extension are substantially laterally aligned (as depicted in the drawing figures with regard to extensions 91 and 92). Alternatively, or in addition to: mounting strap 20 extending tensionally around the upper portion of the pile and being received within (or passing through) first lateral groove 133; a further mounting strap 23 may extend tensionally around upper portion 55 of elongated body 52 of pile 14 and portion 130 of second side 97 of extension 91/92, with a portion of further mounting strap 23 being received within second lateral groove 136.

The brackets of the support structure of the present invention may have one or more extensions. In an embodiment, the bracket has two separate extensions. With reference to FIG. 3, bracket 17 has a first extension 91 and a second extension 92, each having a first side 94, a second side 97, an upper terminus 100 and a lower terminus 103, and each being as further described previously herein. First extension 91 and second extension 92 are laterally spaced apart from each other and have (or together define) a vertical space 139 between them. More particularly, first extension 91 has an interior side surface 249 that is in facing opposition with an interior side surface 252 of second extension 92. Interior side surface 249 of first extension 91 and interior side surface of second extension 252 together define vertical space 139.

The vertical space defined by the interior side surfaces of adjacent extensions (e.g., first and second extensions 91 and 92) of the bracket may have any suitable shape (e.g., U-shapes, V-shapes and/or irregular shapes). For example, as depicted in FIG. 3, interior side surface 249 of first extension 91 and interior side surface of second extension 252 are each substantially vertical surfaces (e.g., forming an angle of 0° relative to vertical), and vertical space 139 defined thereby is accordingly a substantially U-shaped vertical space. At least one of the interior side surfaces of adjacent extensions may form an angle relative to vertical that is greater than 0° and less than 90°.

Figure 14:
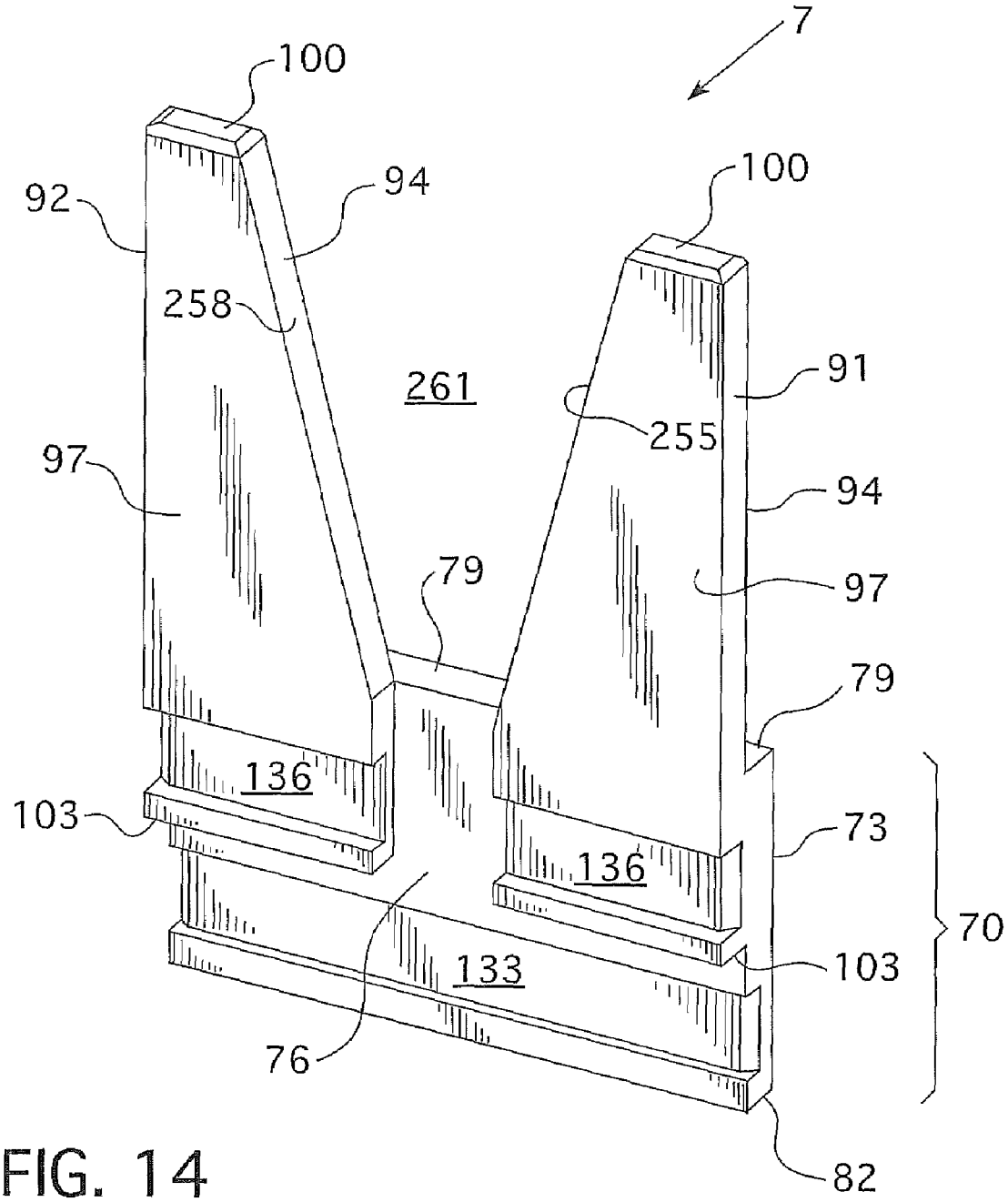

Providing a bracket in which one or more of the interior side surfaces of the extensions are angled surfaces, allows a vertically oriented bracket to supportively receive the sidewall (and/or corner) of a support panel therein and/or thereagainst such that the upper support surface of the support panel is other than horizontal. For example, a support panel (and its upper support surface) may be oriented so as to act as an angled ramp between a separate structure (e.g., a river bank) and the support structure, or between different portions of the support structure having different vertical levels. Providing a bracket in which one or more of the interior side surfaces of the extensions thereof are angled surfaces facilitates such non-horizontal orientation of the support panels of the support structure of the present invention. With reference to FIG. 14, first extension 91 of bracket 7 has an interior side surface 255, and second extension 92 has an interior side surface 258, which each independently form an angle relative to vertical that is greater than 0° and less than 90°. Interior side surface 255 of first extension 91 and interior side surface 258 of second extension 92 are in facing opposition relative to each other, and together define vertical space 261 there-between. Vertical space 261 is a substantially V-shaped vertical space.

As described previously herein, support panel 11 may have at least two sidewalls (e.g., 33 and 33') that are adjacent sidewalls, and which together define a corner 37. In an embodiment of the present invention, in addition to a portion of sidewall 33 being received and residing within vertical slot 112, a corner 37 of support panel 11 may also be received and reside within the vertical space 139 residing between the adjacent and spaced apart first extension 91 and second extension 92 of bracket 17. See, for example, FIG. 6.

The various elements of the bracket, including any combination of the lower portion, the retainer and the extension(s), may be separately assembled together, in which case the bracket is a non-unitary bracket. For example, the various elements of the bracket may be separately fabricated and then assembled together, for example, by means of fasteners, adhesives and/or welding (e.g., high frequency welding in the case of thermoplastics, or arc welding in the case of metals). In an embodiment, the bracket is a substantially unitary bracket, and as such the elements thereof (e.g., lower portion 70, extension(s) 91/92, and retainer 85) are substantially continuous with each other. The bracket may be fabricated by molding (e.g., metal or plastic molding) in a single mold, in which case the elements of the bracket are formed substantially concurrently, thus resulting in the formation of a substantially unitary bracket.

In an embodiment of the present invention, the elongated body of each pile includes first and second exterior elongated plates having a plurality of internal ribs extending laterally there-between. The plurality of internal ribs define first and second elongated open sides of the elongated body (which are each equivalent to the apertured side or sidewall of the pile), and together further define an elongated passage extending the length of the elongated body, that may further include an elongated tube therein.

More particularly, and with reference to FIG. 7, a molded pile 14, according the present invention, is depicted and includes as major components, an elongated body 52 and an elongated tube 142 that resides within elongated body 52. Elongated body 52 includes an upper end 145 and a lower end 148. Elongated body 52 also has an upper portion 55, a lower portion 58, a first exterior elongated plate 151, and a second exterior elongated plate 154. First exterior elongated plate 151 and second exterior elongated plate 154 are spaced apart and are substantially opposed from each other, and each have two opposed elongated edges 65 (only one elongated edge 65 of each of first exterior elongated plate 151 and second exterior elongated plate 154 being visible in FIG. 7).

Elongated body 52 also includes a plurality of internal ribs 157 that are interposed between first exterior elongated plate 151 and second exterior elongated plate 155. Internal ribs 157 define at least one elongated passage 160, and together define a plurality of apertures 67. Elongated passage 160 extends the entire length of elongated body 52 and provides fluid communication between upper end 145 and lower end 148 thereof. The internal ribs 157 of elongated body 52 may have numerous configurations. For example, as depicted in the drawings, internal ribs 157 include angled ribs 106 and cross (or lateral) ribs 109.

Lateral ribs 109 also include an upper surface 121, that may serve as a load bearing surface for separate components that may be attached to elongated body 52 (e.g., one or more brackets, such as bracket 17). In particular, lower surface 88 of retainer 85 of bracket 17 abuts upper load bearing surface 121 of lateral internal rib 109 of elongated body 52 of molded pile 14, with the support structure of the present invention.

First exterior elongated plate 151, second exterior elongated plate 154 and the plurality of internal ribs 157 are each independently fabricated from a plastic material, as will be discussed in further detail herein. Typically, first exterior elongated plate 151, second exterior elongated plate 154 and internal ribs 157 are each fabricated from the same plastic material. First exterior elongated plate 151, second exterior elongated plate 154 and internal ribs 157 are substantially continuous with each other, and, as such, elongated body 52 is a substantially unitary elongated body 52.

The elongated body of the molded pile of the present invention may have numerous cross-sectional shapes. Generally, the elongated body has a substantially rectangular or square cross-sectional shape. The exterior surfaces of the first and second exterior elongated plates may each independently have a profile selected from substantially flat profiles (as depicted in the drawings), convex profiles, concave profiles, and combinations thereof. In addition, the exterior surfaces of the first and second exterior elongated plates may have grooves (e.g., lateral, horizontal, and/or angled grooves), such as vertical groove 236. Providing the exterior surfaces of the first and/or second exterior elongated plates with grooves may enhance insertion of the molded pile into a penetrable material (e.g., soil). The grooves in the exterior surfaces of the first and/or second exterior elongated plates may, for example, provide pathways or channels through which fluidized penetrable material may travel up and away from the lower end of the elongated body as it is driven into a penetrable material.

The molded pile (e.g., 14) of the present invention may also include an elongated tube 142 that resides within elongated passage 160. Elongated tube 142 has an upper opening 163 and a lower opening 166, each of which is in fluid communication with an elongated hollow interior 169 of elongated tube 142. Elongated tube 142 provides fluid communication between upper end 145 and lower end 148 of elongated body 52. In addition, elongated tube 142 is adapted to provide for passage of a fluid (e.g., liquid and/or gas, such as water and/or air) at elevated pressure (i.e., greater than ambient pressure) through the elongated hollow interior 169 thereof. By selection of the materials of fabrication, and sidewall thicknesses, elongated tube 142 may be adapted so as to provide passage of a high pressure fluid there-through, as is known to the skilled artisan.

Figure 12:
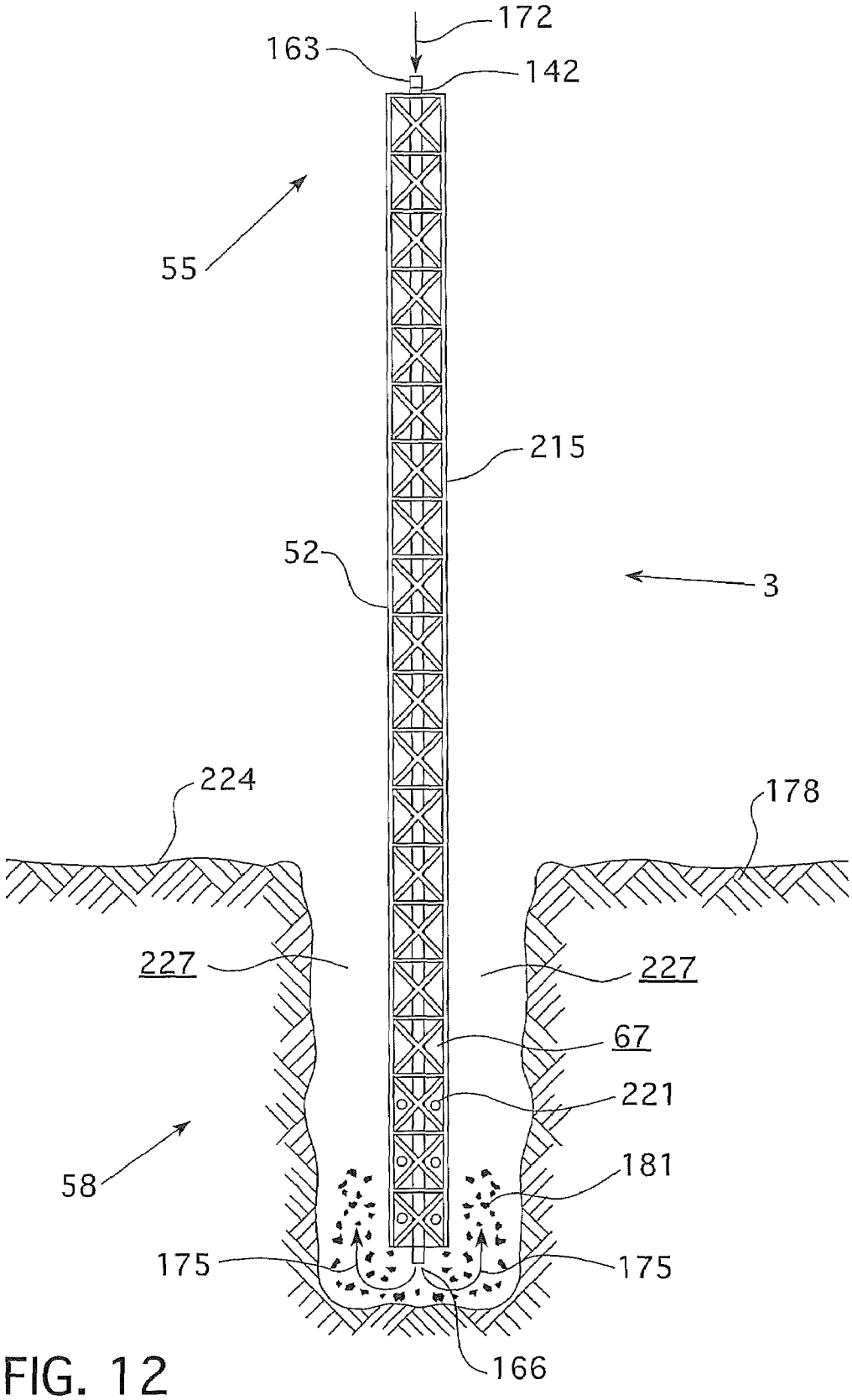
FIG. 12 is a representative partial sectional and side elevational view of the molded pile of FIG. 11 being driven with fluid assistance into a penetrable material.

With reference to FIG. 12, passage of a fluid, such as water and/or air, through elongated tube 142 assists driving of the molded pile (e.g., molded pile 3) of the present invention into a penetrable material 178 (e.g., soil), and anchoring the molded pile therein. The fluid may be selected from gasses (e.g., air and/or nitrogen) and/or liquids (e.g., water and/or organic solvents, such as alcohols, such as methanol and/or ethanol, hydrocarbons and/or ketones). The fluid may optionally further include an abrasive particulate material, such as aluminum oxide, silica, silicon carbide, zirconia and mixtures thereof.

More particularly, a fluid at elevated pressure is introduced into upper opening 163 of elongated tube 142 (as represented by arrow 172), passes through the elongated hollow interior 169 thereof and emerges from lower opening 166 of the tube (as represented by arrows 175). The high pressure fluid emerging from lower opening 166 of tube 142 fluidizes the penetrable material 178 (e.g., soil and/or sand) into which lower portion 58 of elongated body 52 is driven. Contact of the high pressure fluid emerging from lower opening 166 of tube 142 fluidizes at least some of the penetrable material 178 it comes into contact with, and thereby forms a fluidized penetrable material 181. The fluidized penetrable material 181 typically comprises particulate penetrable material (e.g., soil particles) suspended in the fluid emerging from lower opening 166 of tube 142. The plurality of apertures 67 of elongated body 52 of the molded pile (e.g., molded pile 3) are dimensioned to receive fluidized penetrable material 181 therein.

Figure 13:
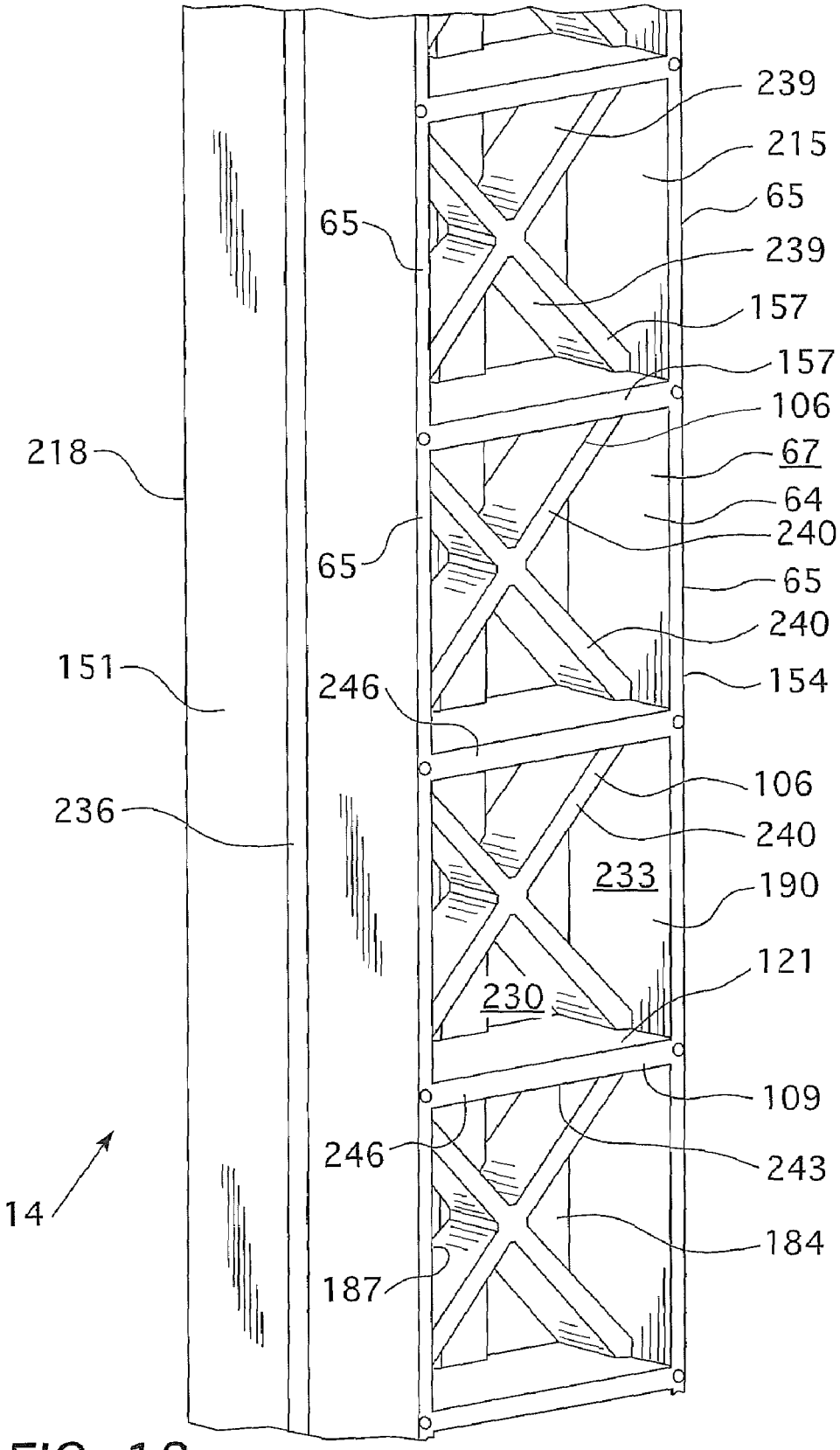
FIG. 13 is a is a representative enlarged perspective view of a portion of the pile of FIG. 7.

The fluidized penetrable material 181 received within apertures 67 of elongated body 52 becomes non-fluidized (in particular when high pressure fluid is no longer passed through tube 142) and substantially continuous with non-fluidized penetrable material surrounding lower portion 58 of elongated body 52. The receipt of fluidized penetrable material into apertures 67, and the subsequent conversion (or reversion) thereof into non-fluidized penetrable material within apertures 67 that is continuous with non-fluidized material there-around, serves to better anchor lower portion 58 of elongated body 52 of the molded pile within the penetrable material (e.g., 178). More particularly, the fluidized penetrable material (e.g., fluidized penetrable material 181 of FIG. 12) enters apertures 67 and comes to rest in a non-fluidized state on and/or against the sidewalls/surfaces of the internal ribs and elongated exterior plates that define the apertures. With reference to FIG. 13, the non-fluidized penetrable material may rest on and/or against: the sidewall surfaces 239 of angled internal ribs 106; the upper surface 121 of cross/lateral internal ribs 109; interior surface 187 of first exterior elongated plate 151; and/or interior surface 190 of second exterior elongated plate 154.

The dimensions of the apertures 67 of the elongated body of the pile, according to the present invention, are typically selected based on a combination of factors, including but not limited to, the type of penetrable material into which the molded pile is driven, the type of fluid that is passed through the elongated tube, and the pressure under which the fluid is passed through the tube. Generally, the plurality of apertures each have a maximum linear dimension (e.g., a bisector in the case of triangular shaped apertures) that is substantially equivalent to 25 percent to 50 percent of the linear distance between the interior surfaces of the first and second exterior elongated plates. In addition, the plurality of apertures 67 each have a depth (relative to the elongated edge 65 of the first and second exterior elongated plates 151, 154) that is substantially equivalent to 25 percent to 50 percent of the width of each of the first 151 and second 154 exterior elongated plate. As such, apertures 67 extend into the first elongated open side (or first apertured sidewall) 215, and the second elongated open side (or second apertured sidewall) 218 of elongated body 52 relative to the elongated edges 65 of the first exterior elongated plate 151 and the second exterior elongated plate 154, and may be referred to as deep apertures 67. The presence of deep apertures 67 enhances the receipt and retention of fluidized penetrable material therein. The first 215 and second 218 elongated open sides of the elongated body will be described in further detail herein.

In an embodiment, the plurality of internal ribs 157 of the elongated body 52 of the molded pile (e.g., molded pile 14) includes an elongated transverse rib 184 that extends substantially the length of elongated body 52 (e.g., from upper end 145 to lower end 148). Elongated transverse rib 184 also extends transversely and continuously between first exterior elongated plate 151 and second exterior elongated plate 154. More particularly, elongated transverse rib 184 extends transversely and continuously between interior surface 187 of first exterior elongated plate 151 and interior surface 190 of second elongated exterior plate 154. In addition, elongated transverse rib 184 defines and contains elongated passage 160. See for example, FIG. 8.

Elongated transverse rib 184 is typically thicker than the other internal ribs of the elongated body. For example, in an embodiment, elongated transverse rib 184 has a thickness that is from 25 percent to 50 percent greater than the average thickness of the other internal ribs (e.g., internal ribs 106 and 109). In addition to defining elongated passage 160 (through which elongated tube 142 extends), elongated transverse rib 184 provides elongated body 52 with improved dimensional stability.

That portion of elongated transverse rib 184 that defines elongated passage 160 may have open or closed sidewalls 194. Typically, that portion of elongated transverse rib 184 that defines elongated passage 160 has substantially continuous and closed sidewalls 194, in which case elongated passage 160 is defined by substantially continuous and closed sidewalls (e.g., sidewalls 194).

Elongated body 52 has a longitudinal axis 197, and elongated passage 160 has a longitudinal axis 200. Longitudinal axis 197 of elongated body 52 and longitudinal axis 200 of elongated passage 160 may be parallel or non-parallel. When longitudinal axis 197 of elongated body 52 and longitudinal axis 200 of elongated passage 160 are non-parallel, elongated passage 160 typically passes at an angle through elongated body 52, and longitudinal axis 197 and longitudinal axis 200 form an offset angle relative to each other (not shown). More typically, longitudinal axis 197 of elongated body 52 and longitudinal axis 200 of elongated passage 160 are parallel with each other. In an embodiment, longitudinal axis 197 of elongated body 52 and longitudinal axis 200 of elongated passage 160 are substantially aligned, as depicted in the drawing figures.

Elongated body 52 may include a top plate 203 that serves to substantially define the upper end 145 of the elongated body. Top plate 203 has an aperture 206 therein that is aligned and in fluid communication with elongated channel 160, and which is dimensioned to receive elongated tube 142 therethrough. Top plate 203 may be fabricated from metal, and separately joined (e.g., by fasteners and/or adhesives) to elongated body 52. In an embodiment of the present invention, top plate 203 is fabricated from plastic material and is continuous with first exterior elongated plate 151, second exterior elongated plate 154, and the plurality of internal ribs 157.

Elongated passage 160 typically has a lower terminus 209 (FIG. 8). The lower opening 166 of elongated tube 142 may be recessed back within elongated passage 160 of elongated body 52, in which case, lower opening 166 resides vertically above lower terminus 209 (not shown). In an embodiment, lower opening 166 of elongated tube 142 is positioned beyond (or vertically below) lower terminus 209 of elongated passage 160 (FIG. 8). Lower opening 166 of elongated tube 142 thus extends out of or beyond elongated channel 160 of elongated body 52. Positioning lower opening 166 of elongated tube 142 beyond lower terminus 209 of elongated passage 160, and beyond lower end 148 of elongated body 52 may be undertaken for reasons, including but not limited to, enhancing fluid assisted driving of the molded pile into a penetrable material, such as soil. With the lower opening 166 of elongated tube 142 so extended (beyond lower terminus 209 of elongated passage 160, and beyond lower end 148 of elongated body 52) high pressure fluid emerging from lower tube end 166 impinges upon and begins to fluidize the penetrable material there-below before the lower end 148 of elongated body 52 contacts the penetrable material, thereby assisting entry or driving of the molded pile into the penetrable material.

Figure 9:
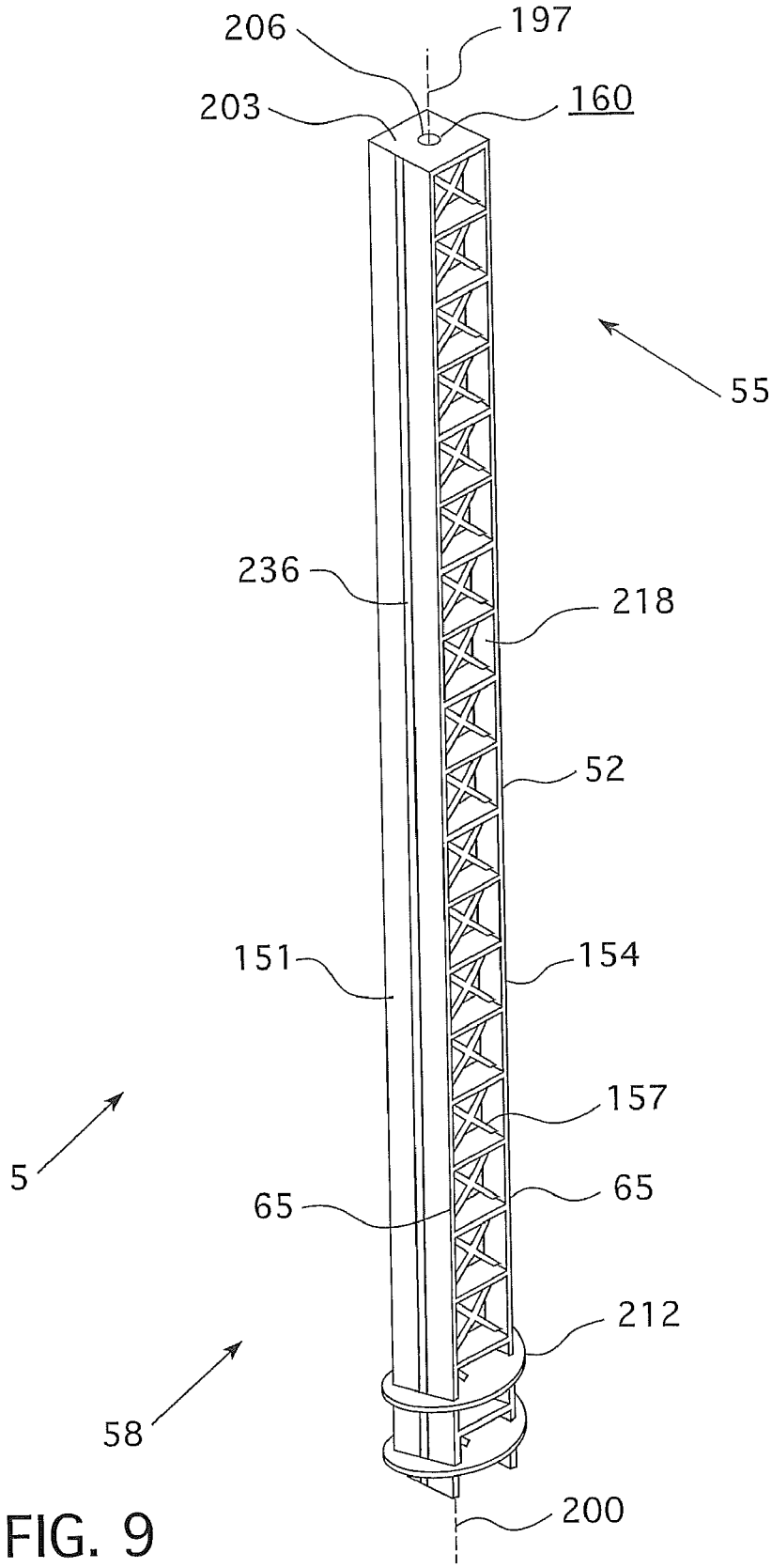
FIG. 9 is a representative perspective view of a pile according to the present invention, in which the lower portion thereof further includes a circumferential helical flange.
Figure 10:
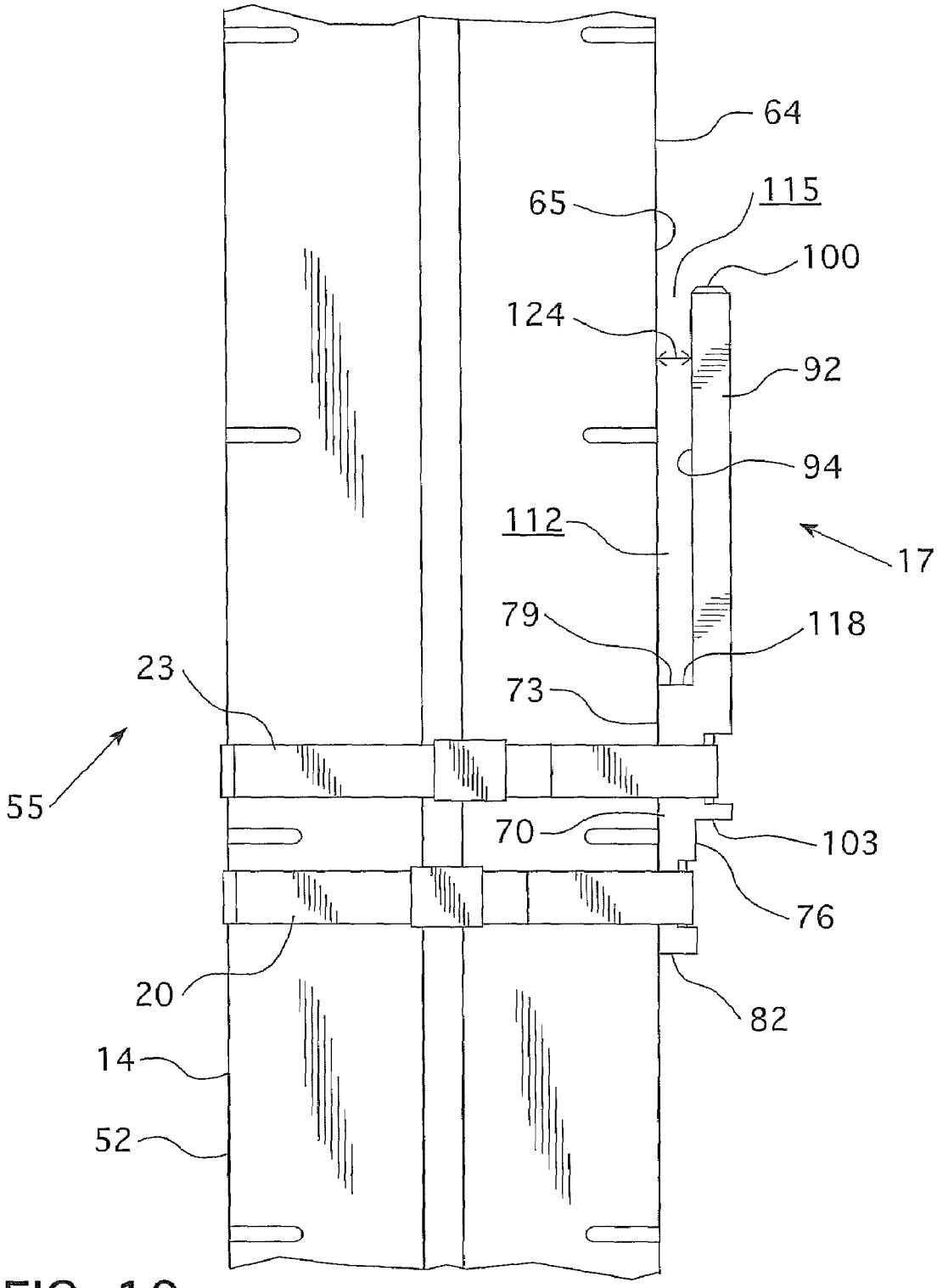
FIG. 10 is a representative side elevational view of the pile, bracket and mounting strap assembly of FIG. 5.

With reference to FIG. 9, the lower portion of 58 of elongated body 52 of the molded pile 5 includes a circumferential helical flange 212 that extends substantially transversely (or laterally) outward relative to the longitudinal axis 197 of elongated body 52. Circumferential helical flange 212 also extends substantially transversely (or laterally) outward beyond first exterior elongated plate 151 and second exterior elongated plate 154 of elongated body 52. Circumferential helical flange 212 is fabricated from plastic material and is substantially continuous with first exterior elongated plate 151, second exterior elongated plate 154 and the plurality of internal ribs 157, and as such circumferential helical flange 212 is part of elongated body 52.

Circumferential helical flange 212 is dimensioned, in an embodiment, so as to auger lower portion 58 into a penetrable material (e.g., soil) as elongated body 52 is rotated about its longitudinal axis 197. To assist augering lower portion 58 of elongated body 52 into a penetrable material, circumferential helical flange 212 may have a downward spiral. In addition to assisting augering lower portion 58 of elongated body 52 into a penetrable material, circumferential helical flange 212 may also assist removal of lower portion 58 from the penetrable material by rotating elongated body 52 in the opposite direction around its longitudinal axis 197.

The apertures defined by the plurality of internal ribs of the elongated body may have any suitable shape, provided they are capable of receiving and retaining fluidized penetrable material therein. For example, the plurality of apertures 67 defined by the plurality of internal ribs 157 may have shapes selected from polygonal shapes (e.g., triangular, square, rectangular, pentagonal, hexagonal, heptagonal, octagonal, etc.), circular shapes, oval shapes, irregular shapes and combinations thereof. As depicted in the drawings, internal ribs 157 define apertures 67 having substantially polygonal shapes, and, in particular substantially triangular shapes and substantially rectangular shapes (the triangular shaped apertures 230 being recessed within the larger rectangular shaped apertures 233—FIG. 13).

In an embodiment of the present invention, and with further reference to FIG. 13, the elongated body, and, in particular, the first and second elongated open sides (215, 218) of the elongated body 52 include recessed internal ribs 106 having sidewall surfaces 239 that (optionally together with the interior surfaces 187 and 190 of the first and second exterior elongated plates 151, 154) define recessed apertures 230 (e.g., triangular recessed apertures 230). Recessed internal ribs 106 have ridges 240 that are recessed within the elongated open sides (215, 218) of the elongated body relative to the elongated edges 65 of the first 151 and second 154 exterior elongated plates.

Alternatively, or in addition to recessed internal ribs 106 that define recessed apertures 230, the elongated body, and more particularly the first and second elongated open sides (215, 218) of elongated body 52 may include non-recessed internal ribs 109 having sidewall surfaces 121 and 243 that (optionally together with the interior surfaces 187 and 190 of the first and second exterior elongated plates 151 and 154) define non-recessed apertures 233 (e.g., rectangular apertures 233). Non-recessed internal ribs 109 have ridges 246 that are substantially flush with and/or extend outward relative to (e.g., beyond) the elongated edges 65 of the first 151 and second 154 exterior elongated plates. As depicted in FIG. 13, ridges 246 of non-recessed internal ribs 109 are substantially flush with the elongated edges 65 of the first 151 and second 154 exterior elongated plates.

The elongated body 52, in an embodiment, may have (in addition to the first and second exterior elongated plates) a first elongated open side 215 and a second elongated open side 218 that are substantially opposed to each other (and which may also be equivalently referred to herein as an apertured sidewall, such as first and second apertured sidewalls, respectively). The first elongated open side 215 and the second elongated open side 218 are each defined by the plurality of internal ribs 157. Second elongated open side 218 is not visible in the drawings. The first elongated open side 215 and the second elongated open side 218 of elongated body 52 may be substantially symmetrical (e.g., each having the same configuration of internal ribs 157 and associated apertures 67), or unsymmetrical (e.g., each having a different configuration of internal ribs 157 and associated apertures 67). Typically, first elongated open side 215 and second elongated open side 218 of elongated body 52 are substantially symmetrical, and each have substantially the same configuration of internal ribs 157 and associated apertures 67. The first elongated open side 215 and the second elongated open side 218 may each independently be referred to as an apertured sidewall 64.

When elongated body 52 includes first elongated open side 215 and second elongated open side 218, at least one aperture 67 defined by the plurality of internal ribs 157 may provide fluid communication between the first elongated open side 215 and the second elongated open side 218, in particular, in the area of the lower portion 58 of elongated body 52. For example, at least one aperture 67 may itself be a perforation, or include a perforation that provides such fluid communication between the first and second elongated open sides.

Figure 11:
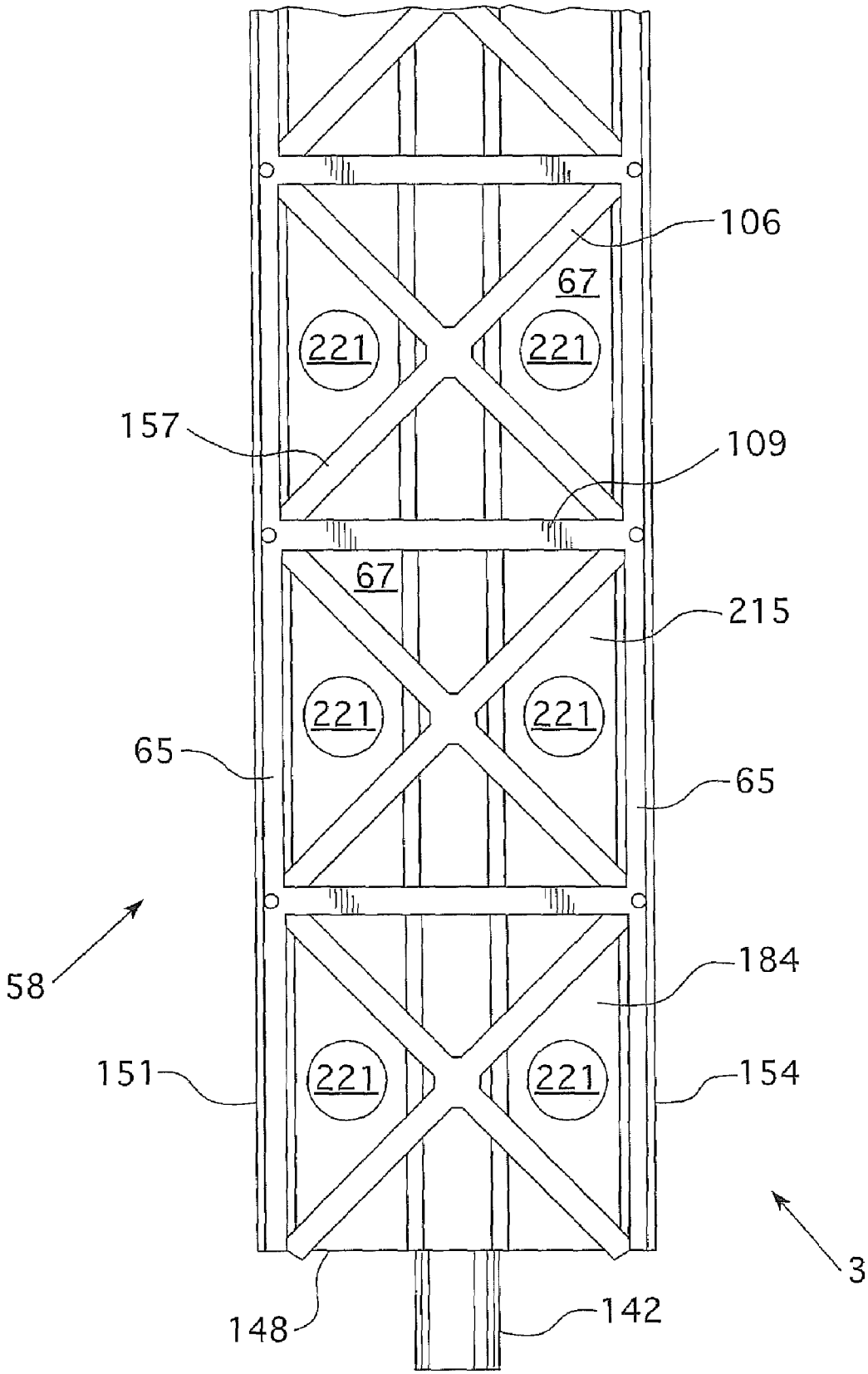
FIG. 11 is a representative elevational view of a first elongated open side (or apertured sidewall) of the lower portion of a molded pile according to the present invention that further includes perforations that provide fluid communication between the first and second elongated open sides thereof.

With reference to FIGS. 11 and 12, some of the internal ribs 157 of lower portion 58 of elongated body 52 define apertures 67 that further include perforations 221 that provide fluid communication between first elongated open side 215 and second elongated open side 218 (not visible). More particularly, internal ribs 157 define the perforations 221. Further particularly, elongated transverse rib 184 (which is an internal rib) defines and includes the perforations 221.

Providing the internal ribs of the lower portion of the elongated body with apertures/perforations that provide fluid communication between the first and second elongated open sides of the elongated body, further enhances anchoring of the lower portion thereof within a penetrable material, such as earth (e.g., soil and/or sand). As molded pile 3 is driven into a penetrable material (by fluid assistance), fluidized penetrable material (e.g., 181) enters apertures 67 of first elongated open side 215 and second elongated open side 218, and passes there-between through perforations 221 in elongated transverse rib 184. When the fluidized penetrable material converts to (e.g., back to) a non-fluidized state, non-fluidized penetrable material within apertures 67 extends from first elongated open side 215 to second elongated open side 218 (and visa versa) through perforations 221. The non-fluidized penetrable material within aperture 67 is also (or becomes) continuous with non-fluidized material surrounding lower portion 58 of elongated body 52. As such, a continuum of non-fluidized penetrable material exists around lower portion 58 of elongated body 52, in the apertures 67 of the first and second elongated open sides (215, 218), and between the first and second elongated open sides (215, 218) via perforations 221. Such a continuum of non-fluidized penetrable material surrounding and extending through lower portion 58 of elongated body 58 serves to better anchor lower portion 58 within the penetrable material.

The penetrable material may be selected from any material into which the molded pile may be driven and anchored. The penetrable material may be selected from, for example, grain (e.g., edible grain, such as corn, barley and/or wheat, and non-edible grain, such as grass and/or flower seed), earth (e.g., sand and/or soil), ice, snow, cementatious material (e.g., cement, such as Portland cement) and combinations thereof. When the penetrable material is earth, such as sand and/or soil, it may further include aggregate materials, such as rocks and/or cinders, provided they are not so large as to prevent the molded pile from being driven therein. In the case of cementatious materials, such as cement, the molded pile may be driven down into: liquid cement; or earth followed by the introduction of liquid cement into a cavity formed around the lower portion of the elongated body. The cementations material may be introduced through the elongated tube and/or poured into the cavity.

The elongated tube of the molded pile of the present invention may have any suitable cross-sectional shape, provided high pressure fluid may be passed there-through. For example, the elongated tube may have a cross-sectional shape (i.e., as defined by the exterior surface of the sidewalls of the elongated tube) selected from polygonal shapes (e.g., triangular, square, rectangular, pentagonal, hexagonal, heptagonal, octagonal, etc.) circular shapes, oval shapes (e.g., elliptical shapes), irregular shapes and combinations thereof. The elongated hollow interior (e.g., 169) may have a cross-sectional shape that is the same or different than that of the elongated tube. The cross-sectional shape of the elongated hollow interior being defined by the interior surfaces of the sidewall of the elongated tube. The cross-sectional shape of the elongated hollow interior of the elongated tube may be selected from polygonal shapes (e.g., triangular, square, rectangular, pentagonal, hexagonal, heptagonal, octagonal, etc.) circular shapes, oval shapes (e.g., elliptical shapes), irregular shapes and combinations thereof. Typically, the elongated tube and the elongated hollow interior thereof each have substantially the same cross-sectional shape.

Elongated tube 142 may be loosely held within elongated passage 160 of elongated body 52. In an embodiment, elongated tube 142 is fixedly held within elongated passage 160 of elongated body 52. Elongated tube 142 may be fixedly held within elongated passage 160 by art-recognized means, such as adhesives, and/or clamps positioned at the upper 163 and lower 166 openings of the elongated tube.

In an embodiment, the elongated tube is fixed (i.e., caused to be fixedly held) within the elongated passage during mold formation of the elongated body. The elongated tube may, for example, be suspended within a mold cavity followed by the introduction of a fluid (e.g., molten) plastic material into the mold cavity, thereby encasing and fixing the elongated tube within the introduced plastic material, in accordance with art-recognized methods. Fixing the elongated tube within the elongated passage during mold formation of the elongated body, in effect, results in the concurrent formation of the elongated passage (by the exterior surfaces of the elongated tube) and fixing of the elongated tube within the introduced plastic material.

The support structure of the present invention may be free of load bearing support cross-members extending laterally between adjacent piles, which would be present for purposes of providing support for the support panel(s) 11. The pile (14), bracket (17), and mounting strap (20, 23) assembly, or combination of the present invention, provides sufficient support for the support panel(s) 11, thus typically negating the need for support cross-members to be present.

The various components of the support structure of the present invention, such as the support panels, the piles, the brackets and the mounting straps may each independently be fabricated from a plastic material selected from thermoset plastic materials, thermoplastic materials and combinations thereof. In addition, the various components of the molded pile, including but not limited to, the first exterior elongated plate, the second exterior elongated plate, the plurality of internal ribs, the top cap, and the elongated tube, may each independently be fabricated from a plastic material selected from thermoset plastic materials, thermoplastic materials and combinations thereof. As used herein and in the claims, the term "thermoset plastic material" and similar terms, such as "thermosetting or thermosetable plastic materials" means plastic materials having, or that form, a three dimensional crosslinked network resulting from the formation of covalent bonds between chemically reactive groups, e.g., active hydrogen groups and free isocyanate groups, or between unsaturated groups.

Thermoset plastic materials from which the plastic material of the various components of the support structure (e.g., the support panels and piles, and various components of the piles) may each be independently fabricated, include those known to the skilled artisan, e.g., crosslinked polyurethanes, crosslinked polyepoxides, crosslinked polyesters and crosslinked polyunsaturated polymers. The use of thermosetting plastic materials typically involves the art-recognized process of reaction injection molding. Reaction injection molding typically involves, as is known to the skilled artisan, injecting separately, and preferably simultaneously, into a mold, for example: (i) an active hydrogen functional component (e.g., a polyol and/or polyamine); and (ii) an isocyanate functional component (e.g., a diisocyanate such as toluene diisocyanate, and/or dimers and trimers of a diisocyanate such as toluene diisocyanate). The filled mold may optionally be heated to ensure and/or hasten complete reaction of the injected components.

As used herein and in the claims, the term "thermoplastic material" and similar terms, means a plastic material that has a softening or melting point, and is substantially free of a three dimensional crosslinked network resulting from the formation of covalent bonds between chemically reactive groups, e.g., active hydrogen groups and free isocyanate groups. Examples of thermoplastic materials from which the plastic material of the components of the support structure (e.g., the support panels, piles, brackets and/or mounting straps) may be independently selected include, but are not limited to, thermoplastic polyurethane, thermoplastic polyurea, thermoplastic polyimide, thermoplastic polyamide, thermoplastic polyamideimide, thermoplastic polyester, thermoplastic polycarbonate, thermoplastic polysulfone, thermoplastic polyketone, thermoplastic polyolefins, thermoplastic(meth) acrylates, thermoplastic acrylonitrile-butadiene-styrene, thermoplastic styrene-acrylonitrile, thermoplastic acrylonitrile-stryrene-acrylate and combinations thereof (e.g., blends and/or alloys of at least two thereof).

In an embodiment of the present invention, the thermoplastic material of the components of the support structure (e.g., the support panels, piles, brackets and/or mounting straps) is in each case independently selected from thermoplastic polyolefins. As used herein and in the claims, the term "polyolefin" and similar terms, such as "polyalkylene" and "thermoplastic polyolefin", means polyolefin homopolymers, polyolefin copolymers, homogeneous polyolefins and/or heterogeneous polyolefins. For purposes of illustration, examples of a polyolefin copolymers include those prepared from ethylene and one or more $C_3$-$C_{12}$ alpha-olefins, such as 1-butene, 1-hexene and/or 1-octene.

The polyolefins, from which the thermoplastic material of the components (e.g., the support panels, piles, brackets and/or mounting straps) of the support structure, may in each case be independently selected, include heterogeneous polyolefins, homogeneous polyolefins, or combinations thereof. The term "heterogeneous polyolefin" and similar terms means polyolefins having a relatively wide variation in: (i) molecular weight amongst individual polymer chains (i.e., a polydispersity index of greater than or equal to 3); and (ii) monomer residue distribution (in the case of copolymers) amongst individual polymer chains. The term "polydispersity index" (PDI) means the ratio of $M_w/M_n$, where $M_w$ means weight average molecular weight, and $M_n$ means number average molecular weight, each being determined by means of gel permeation chromatography (GPC) using appropriate standards, such as polyethylene standards. Heterogeneous polyolefins are typically prepared by means of Ziegler-Natta type catalysis in heterogeneous phase.

The term "homogeneous polyolefin" and similar terms means polyolefins having a relatively narrow variation in: (i) molecular weight amongst individual polymer chains (i.e., a polydispersity index of less than 3); and (ii) monomer residue distribution (in the case of copolymers) amongst individual polymer chains. As such, in contrast to heterogeneous polyolefins, homogeneous polyolefins have similar chain lengths amongst individual polymer chains, a relatively even distribution of monomer residues along polymer chain backbones, and a relatively similar distribution of monomer residues amongst individual polymer chain backbones. Homogeneous polyolefins are typically prepared by means of single-site, metallocene or constrained-geometry catalysis. The monomer residue distribution of homogeneous polyolefin copolymers may be characterized by composition distribution breadth index (CDBI) values, which are defined as the weight percent of polymer molecules having a comonomer residue content within 50 percent of the median total molar comonomer content. As such, a polyolefin homopolymer has a CDBI value of 100 percent. For example, homogenous polyethylene/alpha-olefin copolymers typically have CDBI values of greater than 60 percent or greater than 70 percent. Composition distribution breadth index values may be determined by art recognized methods, for example, temperature rising elution fractionation (TREF), as described by Wild et al, Journal of Polymer Science, Poly. Phys. Ed., Vol. 20, p. 441 (1982), or in U.S. Pat. No. 4,798,081, or in U.S. Pat. No. 5,089,321. An example of homogeneous ethylene/alpha-olefin copolymers are SURPASS polyethylenes, commercially available from NOVA Chemicals Inc.

The plastic material of the various components of the support structure (e.g., the support panels, piles, brackets and/or mounting straps) may in each case independently and optionally include a reinforcing material selected, for example, from glass fibers, glass beads, carbon fibers, metal flakes, metal fibers, polyamide fibers (e.g., KEVLAR polyamide fibers), cellulosic fibers, nanoparticulate clays, talc and mixtures thereof. If present, the reinforcing material is typically present in a reinforcing amount, e.g., in an amount of from 5 percent by weight to 60 or 70 percent by weight, based on the total weight of the component. The reinforcing fibers, and the glass fibers, in particular, may have sizings on their surfaces to improve miscibility and/or adhesion to the plastic materials into which they are incorporated, as is known to the skilled artisan.

In an embodiment of the invention, the reinforcing material is in the form of fibers (e.g., glass fibers, carbon fibers, metal fibers, polyamide fibers, cellulosic fibers and combinations of two or more thereof). The fibers typically have lengths (e.g., average lengths) of from 0.5 inches to 4 inches (1.27 cm to 10.16 cm). The various components of the support structure of the present invention (e.g., the support panels, piles, brackets and/or mounting straps) may each independently include fibers having lengths that are at least 50 or 85 percent of the lengths of the fibers that are present in the feed materials from which each individual component is prepared, such as from 0.25 inches to 2 or 4 inches (0.64 cm to 5.08 or 10.16 cm). The average length of fibers present in components of the support structure may be determined in accordance with art recognized methods. For example, the support panel may be pyrolyzed to remove the plastic material, and the remaining or residual fibers microscopically analyzed to determine their average lengths, as is known to the skilled artisan.

Fibers are typically present in the plastic materials of the various components of the support structure (e.g., the support panels and/or piles) in amounts independently from 5 to 70 percent by weight, 10 to 60 percent by weight, or 30 to 50 percent by weight (e.g., 40 percent by weight), based on the total weight of the component (i.e., the weight of the plastic material, the fiber and any additives). Accordingly, the various components of the support structure (e.g., the support panels, piles, brackets and/or mounting straps) may each independently include fibers in amounts of from 5 to 70 percent by weight, 10 to 60 percent by weight, or 30 to 50 percent by weight (e.g., 40 percent by weight), based on the total weight of the particular component (or combinations of portions thereof that include reinforcing fibers).

The fibers may have a wide range of diameters. Typically, the fibers have diameters of from 1 to 20 micrometers, or more typically from 1 to 9 micrometers. Generally each fiber comprises a bundle of individual filaments (or monofilaments). Typically, each fiber is composed of a bundle of 10,000 to 20,000 individual filaments.

Typically, the fibers are uniformly distributed throughout the plastic material. During mixing of the fibers and the plastic material, the fibers generally form bundles of fibers typically comprising at least 5 fibers per fiber bundle, and preferably less than 10 fibers per fiber bundle. While not intending to be bound by theory, it is believed, based on the evidence at hand, that fiber bundles containing 10 or more fibers may result in a molded article, such as a molded support structure (or components thereof) having undesirably reduced structural integrity. The level of fiber bundles containing 10 or more fibers per bundle, may be quantified by determining the Degree of Combing present within a molded article. The number of fiber bundles containing 10 or more fibers per bundle is typically determined by microscopic evaluation of a cross section of the molded article, relative to the total number of microscopically observable fibers (which is typically at least 1000). The Degree of Combing is calculated using the following equation: 100×((number of bundles containing 10 or more fibers)/(total number of observed fibers)). Generally, the molded support beam (or portions thereof) has/have a Degree of Combing of less than or equal to 60 percent, and typically less than or equal to 35 percent.

In addition or alternatively to reinforcing material(s), the plastic materials of the various components of the support structure (e.g., the support panels, piles, brackets and/or mounting straps) may in each case independently and optionally include one or more additives. Additives that may be present in the plastic materials of the various components of the support structure of the present invention include, but are not limited to, antioxidants, colorants, e.g., pigments and/or dyes, mold release agents, fillers, e.g., calcium carbonate, ultraviolet light absorbers, fire retardants and mixtures thereof. Additives may be present in the plastic material of each component of the support structure in functionally sufficient amounts, e.g., in amounts independently from 0.1 percent by weight to 10 percent by weight, based on the total weight of the particular component.

The plastic components of the support structure of the present invention (e.g., the support panels, piles, brackets and/or mounting straps) may be prepared by art-recognized methods, including, but not limited to, injection molding, reaction injection molding, compression molding and combinations thereof. The plastic components of the support structure may be fabricated by a compression molding process that includes: providing a compression mold comprising a lower mold portion and an upper mold portion; forming (e.g., in an extruder) a molten composition comprising plastic material and optionally reinforcing material, such as fibers; introducing, by action of gravity, the molten composition into the lower mold portion; compressively contacting the molten composition introduced into the lower mold portion with the interior surface of the upper mold portion; and removing the molded component (e.g., support panel or pile) from the mold. The lower mold portion may be supported on a trolley that is reversibly moveable between: (i) a first station where the molten composition is introduced therein; and (ii) a second station where the upper mold portion is compressively contacted with the molten composition introduced into the lower mold portion.

If the two or more components of the elongated body (e.g., the first and second elongated exterior plates, and/or the internal ribs thereof) of the molded pile are fabricated from different plastic materials (or compositions), different plastic materials/compositions may be concurrently and/or sequentially introduced into different portions of the mold, in which the various components are formed. Generally, the various components of the elongated body (e.g., the first and second elongated exterior plates, the internal ribs, and optionally the top cap) are all fabricated from the same plastic material, and as such a single plastic composition is introduced into the mold.

The lower mold portion may be moved concurrently in time and space (e.g., in x-, y- and/or z-directions, relative to a plane in which the lower mold resides) as the molten composition is gravitationally introduced therein. Such dynamic movement of the lower mold portion provides a means of controlling, for example, the distribution, pattern and/or thickness of the molten composition that is gravitationally introduced into the lower mold portion. Alternatively, or in addition to movement of the lower mold portion in time and space, the rate at which the molten composition is introduced into the lower mold portion may also be controlled. When the molten composition is formed in an extruder, the extruder may be fitted with a terminal dynamic die having one or more reversibly positionable gates through which the molten composition flows before dropping into the lower mold portion. The rate at which the molten composition is gravitationally deposited into the lower mold portion may be controlled by adjusting the gates of the dynamic die.

The compressive force applied to the molten plastic composition introduced into the lower mold portion is typically from 25 psi to 550 psi (1.8 to 38.7 Kg/cm$^2$), more typically from 50 psi to 400 psi (3.5 to 28.1 Kg/cm$^2$), and further typically from 100 psi to 300 psi (7.0 to 21.1 Kg/cm$^2$). The compressive force applied to the molten plastic material may be constant or non-constant. For example, the compressive force applied to the molten plastic material may initially be ramped up at a controlled rate to a predetermined level, followed by a hold for a given amount of time, then followed by a ramp down to ambient pressure at a controlled rate. In addition, one or more plateaus or holds may be incorporated into the ramp up and/or ramp down during compression of the molten plastic material. The plastic components of the support structure of the present invention may, for example, be prepared in accordance with the methods and apparatuses described in U.S. Pat. Nos. 6,719,551; 6,869,558; 6,900,547; and 7,208,219.

In an embodiment of the present invention, the components of the support structure (e.g., the support panel and pile) are each independently a molded article formed from a molten composition comprising fibers (e.g., glass fibers, carbon fibers, metal fibers, polyamide fibers and/or cellulosic fibers). As used with regard to this particular embodiment of the invention herein and in the claims, the term "molded article" means at least one of the plastic components of the support structure, such as the support panel and/or the pile. The molten composition is formed from plastic material and feed fibers. The molten composition may be formed by introducing the plastic material and feed fibers sequentially or concurrently into, and optionally at multiple points along the length of, an extruder. The feed fibers have a length of 1.27 cm (0.5 inches) to 10.16 cm (4 inches). The fibers are present in the molded article (e.g., the support panel and/or pile) in an amount of from 5 percent by weight to 70 percent by weight, based on the total weight of the particular molded article. The fibers of the molded article (e.g., the support panel and/or pile) have lengths (e.g., average lengths) that are at least 60% of the lengths (e.g., average lengths) of the feed fibers, and as such have lengths of, for example: from 0.762 cm (0.3 inches) to 10.16 cm (4 inches); or from 0.762 cm (0.3 inches) to 6.096 cm (2.4 inches). In addition, less than 20 percent of the fibers of the molded article are oriented in the same direction, relative to any of the x-, y- and z-axis (or any combination thereof) of the molded article.

The brackets and mounting straps of the molded support structure may be fabricated from known suitable self-supporting materials, such as thermoplastic materials, thermoset materials, metals (e.g., ferrous based metals, titanium and aluminum), cellulose based materials, such as wood, ceramics, glass, and combinations thereof. Plastic materials, such as, thermoplastic and/or thermoset materials, from which the brackets and mounting straps may be fabricated, may be selected from those classes and examples as described previously herein with regard to the components of the support structure. In addition, the plastic materials of the brackets and mounting straps may each optionally further include reinforcing materials (e.g., glass fibers) including those classes and examples, and in amounts as described previously herein with regard to the various plastic components of support structure.

In a particular embodiment, the brackets and mounting straps are each independently fabricated from at least one metal. Metals from which the brackets and mounting straps may each be independently fabricated include, but are not limited to, iron, steel, nickel, aluminum, copper, titanium and combinations thereof.

The support structure of the present invention may be used in numerous applications. The support structure may be free standing, or it may extend out from a separate structure, such as a building. For example, the support structure may be used as a free standing deck, or a deck extending from a separate structure, such as a house or building, in each case with the lower portions of the piles retained or embedded in soil and/or optionally cement. The support structure may also be used as a dock, such as a marine dock (e.g., a free standing dock, or a dock extending out from a separate structure), in which case, the lower portions of the piles are embedded in material below the water surface, such as a lake bed, river bed or sea bed, while the support panels (or deck panels) are maintained in a position above the water surface by the brackets.

The present invention has been described with reference to specific details of particular embodiments thereof. It is not intended that such details be regarded as limitations upon the scope of the invention except insofar as and to the extent that they are included in the accompanying claims.

What is claimed is:

1. A support structure comprising:

(a) a support panel comprising an upper support surface, an under surface, and at least one sidewall extending downwardly from said under surface, each sidewall having a lower edge;

(b) at least one pile, each pile having an elongated body having an upper portion, a lower portion, and sidewalls, at least one sidewall of said pile being an apertured sidewall having at least one aperture located in said upper portion of said elongated body;

(c) at least one bracket, each bracket comprising, (i) a lower portion having a first side, a second side, an upper ledge, and a base, said first side and said second side of said lower portion being substantially opposed from each other, (ii) a retainer extending laterally outward from said first side of said lower portion of said bracket, and (iii) at least one extension extending vertically upward from said second side of said lower portion of said bracket, each extension having a first side, a second side, an upper terminus, and a lower terminus, said second side of said extension extending laterally outward beyond said second side of said lower portion of said bracket, said upper terminus of said extension residing above said ledge of said lower portion of said bracket, and said lower terminus of said extension residing above said base of said lower portion of said bracket, wherein for each pile, said first side of said lower portion of said bracket abutting said apertured sidewall on said upper portion of said elongated body of said pile, said retainer of said bracket being received within said aperture of said apertured sidewall, and said first side of each extension of said bracket and said apertured sidewall of said pile together defining a vertical slot having an open top and a closed bottom defined by said upper ledge of said lower portion of said bracket; and (d) at least one mounting strap, extending tensionally around said upper portion of said elongated body of said pile and said lower portion of said bracket, thereby maintaining said first side of said lower portion of said bracket and said apertured sidewall of said pile in abutting relationship, and maintaining said retainer within said aperture, wherein, a portion of said sidewall of said support panel is supportively received within said vertical slot such that, at least one of, (i) said upper terminus of said extension abuts said under surface of said support panel, and (ii) said lower edge of said sidewall of said support panel abuts said upper ledge of said lower portion of said bracket.

2. The support structure of claim 1 wherein said mounting strap abuts a portion of said second side of said lower portion of said bracket residing beneath said lower terminus of said extension and above said base of said lower portion of said bracket.

3. The support structure of claim 1 wherein a portion of said second side of said lower portion of said bracket, residing beneath said lower terminus of said extension and above said base of said lower portion of said bracket, has a first lateral groove, a portion of said mounting strap being received within said first lateral groove.

4. The support structure of claim 3 wherein a portion of said second side of said extension, residing beneath said upper ledge of said lower portion of said bracket and above said lower terminus of said extension, has a second lateral groove, a further mounting strap extending tensionally around said upper portion of said pile and said portion of said second side of said extension, residing beneath said upper ledge of said lower portion of said bracket and above said lower terminus of said extension, a portion of said further mounting strap being received within said second lateral groove.

5. The support structure of claim 1 wherein said bracket comprises a first extension and a second extension, each extending vertically upward from said second side of said lower portion of said bracket and each being as defined in claim 1 with regard to said extension, said first extension and said second extension being laterally spaced apart and having a vertical space there-between.

6. The support structure of claim 5 wherein at least two of said sidewalls of said support panel are adjacent sidewalls and together define a corner, said corner residing within said vertical space between said first extension and said second extension of said bracket.

7. The support structure of claim 1 wherein said bracket is a substantially unitary bracket.

8. The support structure of claim 1 wherein said support panel has a perimeter edge, said sidewalls extending downwardly from said under surface and said perimeter edge of said support panel.

9. The support structure of claim 1 wherein said support panel comprises a plurality of perforations extending from said upper support surface to said under surface of said support panel.

10. The support structure of claim 1 wherein said support panel further comprises a plurality of ribs, said ribs being continuous with said under surface and said sidewalls of said support panel.

11. The support structure of claim 10 wherein said support panel is a substantially unitary support panel.

12. The support structure of claim 1 wherein for each pile, said elongated body has an upper end and a lower end and further comprises, (i) a first exterior elongated plate, (ii) a second exterior elongated plate, said first exterior elongated plate and second exterior elongated plate being spaced apart and being substantially opposed from each other, and (iii) a plurality of internal ribs interposed between said first exterior elongated plate and said second exterior elongated plate, said plurality of internal ribs defining at least one elongated passage, and said plurality of internal ribs together defining a plurality of apertures, wherein said first exterior elongated plate, said second exterior elongated exterior plate and said plurality of internal ribs are each independently fabricated from a plastic material and are substantially continuous with each other, and said elongated body is a substantially unitary elongated body, further wherein, said plurality of internal ribs define said apertured sidewall of said pile, and said plurality of apertures include said aperture located in said upper portion of said apertured sidewall.

13. The support structure of claim 12 wherein said retainer of said bracket has a lower surface, said lower surface of said retainer abutting at least one internal rib of said pile.

14. The support structure of claim 12 wherein said pile further comprises, an elongated tube residing within said elongated passage, said elongated tube having an upper opening and a lower opening each being in fluid communication with an elongated hollow interior of said elongated tube, said elongated tube providing fluid communication between said upper end and said lower end of said elongated body, and being adapted to provide for passage of a fluid at elevated pressure through said elongated hollow interior thereof.

15. The support structure of claim 12 wherein said elongated body has a longitudinal axis, said lower portion of said elongated body further comprises a circumferential helical flange that extends substantially transversely outward relative to said longitudinal axis of said elongated body, said circumferential helical flange being fabricated from plastic material and being continuous with said first exterior elongated plate, said second exterior elongated plate and said plurality of internal ribs.

16. The support structure of claim 15 wherein said circumferential helical flange is dimensioned to auger said lower portion of said elongated body into a penetrable material as said elongated body is rotated about said longitudinal axis of said elongated body.

17. The support structure of claim 12 wherein said apertures defined by said plurality of internal ribs have shapes selected from the group consisting of polygonal shapes, circular shapes, oval shapes, irregular shapes and combinations thereof.

18. The support structure of claim 1 wherein said lower portion of each pile is independently retained within a penetrable material.

19. The support structure of claim 18 wherein said penetrable material is selected from the group consisting of grain, sand, soil, snow, ice, cementatious material and combinations thereof.

20. The support structure of claim 1 wherein said support panel and said pile are each independently fabricated from a plastic material, and said plastic material, from which said support panel, and said pile are each independently fabricated, is in each case independently selected from the group consisting of thermoset plastic material, thermoplastic material and combinations thereof.

21. The support structure of claim 20 wherein said support panel, and said pile are each independently fabricated from thermoplastic material selected independently from the group consisting of thermoplastic polyurethane, thermoplastic polyurea, thermoplastic polyimide, thermoplastic polyamide, thermoplastic polyamideimide, thermoplastic polyester, thermoplastic polycarbonate, thermoplastic polysulfone, thermoplastic polyketone, thermoplastic polyolefins, thermoplastic(meth)acrylates, thermoplastic acrylonitrile-butadiene-styrene, thermoplastic styrene-acrylonitrile, thermoplastic acrylonitrile-stryrene-acrylate and combinations thereof.

22. The support structure of claim 20 wherein the plastic material of at least one of said support panel, and said pile is reinforced with a reinforcing material selected independently from the group consisting of glass fibers, glass beads, carbon fibers, metal flakes, metal fibers, polyamide fibers, cellulosic fibers, nanoparticulate clays, talc and mixtures thereof.

23. The support structure of claim 20 wherein said support panel, and said pile are each independently a molded article formed from a molten composition comprising fibers, said molten composition being formed from plastic material and feed fibers having a length of 1.27 cm to 10.16 cm, the fibers being present in said molded article in an amount of from 5 percent by weight to 70 percent by weight, based on the total weight of said molded article, the fibers of said molded article have lengths that are at least 60% of the lengths of said feed fibers, and less than 20% of the fibers of said molded article are oriented in the same direction.

24. The support structure of claim 1 wherein said bracket and said mounting strap are each independently fabricated from a material selected from the group consisting of thermoset materials, thermoplastic materials, metals and combinations thereof.

25. The support structure of claim 24 wherein said bracket and said mounting strap are each independently fabricated from at least one metal.

* * * * *